US009542916B2

(12) United States Patent
Maruyam

(10) Patent No.: US 9,542,916 B2
(45) Date of Patent: Jan. 10, 2017

(54) ELECTRONIC MUSICAL INSTRUMENT AND CONTROL METHOD THEREFOR

(71) Applicant: Yamaha Corporation, Hamamatsu-shi, Shizuoka-ken (JP)

(72) Inventor: Tsuyoshi Maruyam, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 167 days.

(21) Appl. No.: 13/777,792

(22) Filed: Feb. 26, 2013

(65) Prior Publication Data

US 2013/0220103 A1 Aug. 29, 2013

(30) Foreign Application Priority Data

Feb. 27, 2012 (JP) ..... 2012-039830

(51) Int. Cl.
*G10H 1/00* (2006.01)
*G10H 1/18* (2006.01)

(52) U.S. Cl.
CPC ..... *G10H 1/0008* (2013.01); *G10H 1/18* (2013.01)

(58) Field of Classification Search
CPC ..... G10H 1/18
USPC ..... 84/615
See application file for complete search history.

(56) References Cited

U.S. PATENT DOCUMENTS 5,105,709 A * 4/1992 Suzuki ..... 84/615
7,795,524 B2 * 9/2010 Arai ..... G09B 15/002 84/612
2008/0115657 A1 5/2008 Wakiyama

FOREIGN PATENT DOCUMENTS

JP 06-036096 U 5/1994
JP 02-541063 B2 10/1996
JP H09-114461 A 5/1997
JP 2006-267686 A 10/2006
JP 2008-129044 A 6/2008
JP 2009-216772 A 9/2009
JP 2010-079167 A 4/2010

OTHER PUBLICATIONS

Notification of the Second Office Action dated Sep. 23, 2015, for CN Application No. 201310061251.6, filed Feb. 27, 2013, with English translation, 14 pages.

(Continued)

*Primary Examiner* — Jianchun Qin

(74) *Attorney, Agent, or Firm* — Morrison & Foerster LLP

(57) ABSTRACT

A user designates any one of a plurality of types of key ranges via a key range designating switch and designates, for example via a keyboard, a desired key position to be set as a boundary of the designated key range. In response to such user's operations, an actual key range of the designated key range is determined in accordance with the designated boundary key position, and the keyboard is set in a divided usage state, where the keyboard is usable divided in a plurality of key ranges, on the basis of the determined actual key range. For example, once a left (low-pitch-side) key range is designated, the designated boundary key position defines the upper limit of the left key range, while, once a right (high-pitch-side) key range is designated, the designated boundary key position defines the lower limit of the right key range.

19 Claims, 10 Drawing Sheets

(56) References Cited

OTHER PUBLICATIONS

Japanese Notice of Grounds for Rejection dated Aug. 18, 2015, for JP Patent Application No. 2012-039830, six pages with English Translation.
Japanese Decision of Rejection (Final Rejection) dated Mar. 8, 2016, for JP Patent Application No. 2012-039830, with English Translation, five pages.
Notification of the Third Office Action dated Mar. 18, 2016, for CN Application No. 201310061251.6, with English translation, seven pages.
Notification of the First Office Action dated Jan. 29, 2015, for CN Application No. 201310061251.6, filed Feb. 27, 2013, with English translation, 13 pages.
Search Report dated Jan. 29, 2015, for CN Application No. 201310061251.6, filed Feb. 27, 2013, with English translation, four pages.

* cited by examiner

ELECTRONIC MUSICAL INSTRUMENT AND CONTROL METHOD THEREFOR

BACKGROUND

The present invention an electronic musical instrument which can divide a keyboard into a plurality of key ranges and allocate different tone colors to the individual divided key ranges, and a control method for the electronic musical instrument.

Heretofore, there have been known electronic musical instruments which can divide a keyboard into a plurality of key ranges and allocate different tone colors (or tone colors) to the individual divided key ranges. Among such electronic musical instruments is one disclosed in Japanese Patent No. 2541063, according to which a key code that becomes a split key or split point for dividing the key range of the keyboard is determined in response to a user or human player performing first key depression after turning on a split-mode designating switch, and the key range is divided on the keyboard in such a manner that a key range section equal to and higher in pitch than the split mode is set as a right key range while a key range section equal to and lower in pitch than a pitch one semitone lower than the split key is set as a left key range. Further, according to the disclosure of Japanese Patent No. 2541063, a "main voice" is allocated to the right key range, and a "sub voice" is allocated to the left key range.

In the aforementioned prior-art electronic musical instrument, which one of the left and right key ranges the tone pitch of the key depressed for designating the split point belongs to is determined in advance depending on the model of the electronic musical instrument. Thus, the tone pitch of the key depressed by the user for designating the split point with the intention that the depressed key should be the lowest-pitch tone of the right key range might undesirably become the highest-pitch tone of the left key range, or conversely, the tone pitch of the key depressed by the user intending that the depressed key should be the highest-pitch tone of the left key range might undesirably become the lowest-pitch tone of the right key range.

Further, with the aforementioned prior-art electronic musical instrument, a user's key-range diving operation has to be performed after the user first shifts an operation mode of the electronic musical instrument to a split mode. Further, a user's operating for setting tone colors to the divided key ranges has to be performed after cancellation of the split mode. More specifically, the operation for setting tone colors to the divided key ranges is performed after the operation mode is shifted to a dual mode in the aforementioned prior-art electronic musical instrument, whereas such an operation is performed after the operation mode is shifted to a tone color allocation mode in many other conventionally-known electronic musical instruments. Namely, in the aforementioned conventionally-known electronic musical instrument, there is no linkage between the key-range dividing operation and the operation for setting tone colors to the divided key ranges (i.e., key-range-specific tone color setting operation), and thus, these operations tend to be difficult for a user who is not accustomed to the operations.

SUMMARY OF THE INVENTION

In view of the foregoing prior art problems, it is a first object of the present invention to provide an improved electronic musical instrument which can clearly indicate to a user which one of divided key ranges a tone pitch designated for designating a split point belongs to, and a program for implementing a control method for such an electronic musical instrument.

It is a second object of the present invention to provide an improved electronic musical instrument which allows even an unaccustomed user to readily perform a key-range dividing operation and a key-range-specific tone color setting operation by interlinking the key-range dividing operation and the key-range-specific tone color setting operation, and a program for implementing a control method for such an electronic musical instrument.

In order to accomplish the above-mentioned objects, the present invention provides an improved electronic musical instrument, which comprises: a key range designation section adapted to individually designate any one of a plurality of types of key ranges of a keyboard; a key range determination section adapted to receive information designating a boundary key position in association with designation of the key range by the key range designation section and determine an actual key range of the designated key range in accordance with the boundary key position designated by the received information; and a key-range-division setting section adapted to, on the basis of the actual key range determined by the key range determination section, set the keyboard in a divided usage state where the keyboard is usable divided in a plurality of key ranges.

According to the invention arranged as above, once any one of the types of key ranges is designated by the key range designation section, for example, in response to a user's operation and information designating a desired boundary key position is input, for example, by a user's key depression operation, the key range determination section receives the information designating the desired boundary key position and determines an actual key range of the designated key range in accordance with the boundary key position designated by the received information. Then, on the basis of the actual key range determined by the key range determination section, the keyboard is set in the divided usage state where the keyboard is usable divided in a plurality of key ranges. Thus, the user is allowed to clearly grasp whether the input boundary key position becomes the highest-pitch note or the lowest-pitch note of the designated key range.

In one embodiment, the electronic musical instrument further comprises: a tone color designation section adapted to designate any one of a plurality of tone colors; and a tone color setting section adapted to, once any one tone color is designated by the tone color designation section in association with designation of the key range by the key range designation section, set the designated tone color as a tone color to be used in the designated key range. Thus, once any one tone color is designated while any one of the types of key ranges is designated, the designated tone color is set for the designated key range. In this way, tone color setting can be performed per key range with ease and intuitively.

According to another aspect of the present invention, there is provided an improved electronic musical instrument, which comprises: a key range designation section adapted to individually designate any one of a plurality of types of key ranges; a tone color designation section adapted to designate any one of a plurality of tone colors; a storage section storing boundary information for allowing a keyboard to be used divided in a plurality of key ranges; a division and tone color setting section adapted to, once any one tone color is designated by the tone color designation section in association with designation of a key range by the key range designation section when the keyboard is not set in a divided usage state where the keyboard is usable divided in a plurality of key ranges, (1) divide the keyboard into a plurality of key ranges on the basis of the boundary information stored in the storage section and (2) set the designated tone color as a tone color to be used in the designated key range; and an update section adapted to, once information designating a boundary key position in association with designation of a key range by the key range designation section is received when the keyboard is set in the divided usage state, update the boundary information stored in the storage section on the basis of the designated key range and the boundary key position indicated by the received information. Once the boundary information is updated by the update section, the division and tone color setting section re-sets a key-range-divided state of the keyboard on the basis of the updated boundary information.

Once any one tone color is designated while any one type of key range is designated with the keyboard undivided in a plurality of key ranges, not only a boundary between key ranges is determined on the basis of the boundary information stored in the storage section so that the keyboard is automatically divided into a plurality of key ranges, but also the designated tone color is set for the designated type of key range. Namely, the key range setting operation and tone color setting operation are interlinked or integrated in the present invention, and thus, even a user who is not accustomed to the operations (unaccustomed user) can perform the operations with an utmost ease. Further, because the user first designates a type of key range as an object of setting, it can become clear what (upper and lower limits, tone color, etc. of a key range) are being set for which key range, and thus, user-intended setting can be performed reliably and easily.

Here, the "boundary information" corresponds to a "split point" mentioned in relation to later-described step S24 of FIG. 4A and a "duo-mode point" mentioned in relation to later-described step S38 of FIG. 5. Note. however, that, because the "duo-mode point" is set as the "split point", it can be said that the term "split point" embraces the "duo-mode point". Further, in the present invention, each of the "split point" and "duo-mode point" specifies one of an upper limit and lower limit of a key range. The present invention is so constructed because, if one of the upper and lower limits is identified by the "split point" or the "duo-mode point", then the other of the upper and lower limits can be uniquely identified through an arithmetic operation or otherwise. As an alternative, the present invention may be constructed to specify both of the upper and lower limits. Further, in a later-described embodiment, the keyboard is divided into two key ranges, i.e. left and right key ranges, and the leftmost key of the keyboard is set as the lower limit of the left key range while the rightmost key of the keyboard is set as the upper limit of the right key range; thus, this embodiment does not require information specifying the lower limit of the left key range and the upper limit of the right key range. However, if the keyboard is divided into three or more key ranges or if the lower limit of the left key range or the upper limit of the right key range cannot be uniquely determined, then information allowing such limits to be identified may be used as the "boundary information". In short, the "boundary information" employed in the present invention may be of any desired type as long as it allows extents of individual key ranges to be identified (or determined).

The present invention may be constructed and implemented not only as the apparatus invention discussed above but also as a method invention. Also, the present invention may be arranged and implemented as a software program for execution by a processor, such as a computer or DSP, as well as a non-transitory storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
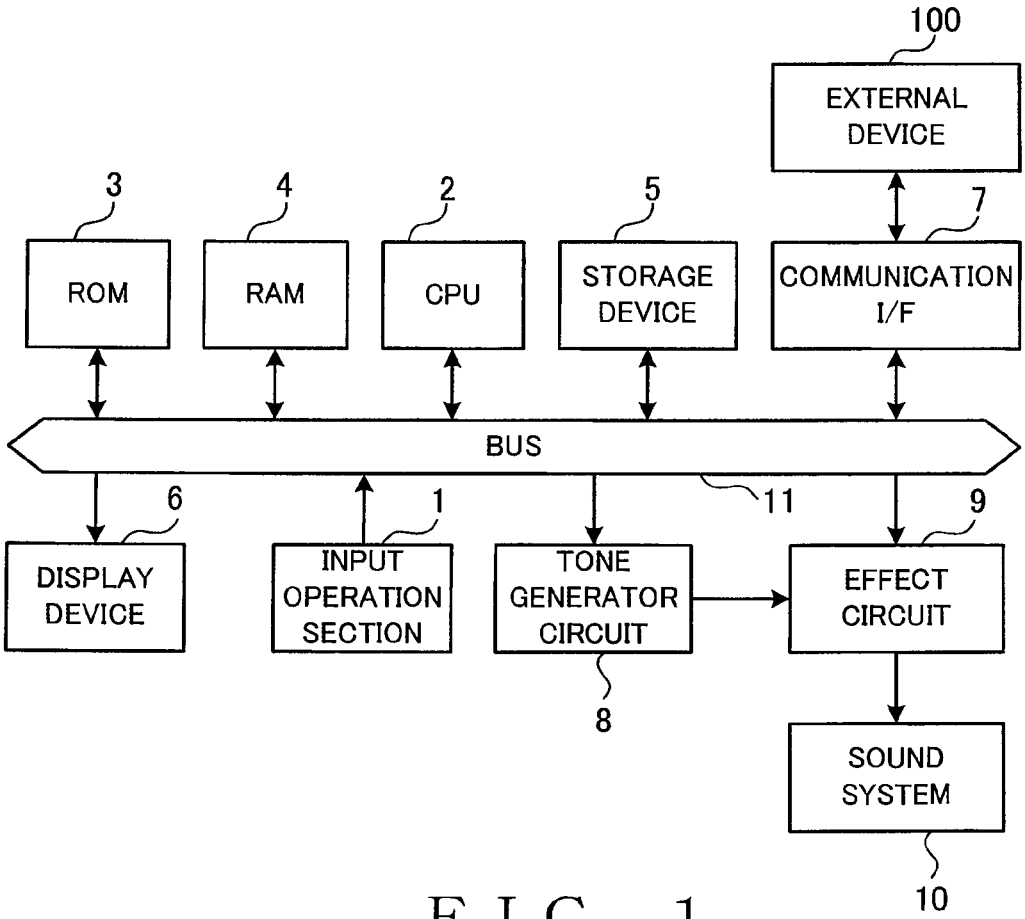
FIG. 1 is a block diagram showing a schematic construction of a preferred embodiment of an electronic musical instrument of the present invention.

FIG. 1 is a block diagram showing a schematic construction of a preferred embodiment of an electronic musical instrument of the present invention. As shown, the embodiment of the electronic musical instrument includes: an input operation section 1 including a performance operator unit, having a keyboard and a pedal, and setting operators, such as switches; a CPU 2 controlling the entire electronic musical instrument; a ROM 3 storing control programs for execution by the CPU 2 and various table data, etc.; a RAM 4 temporarily storing performance information input using the performance operator unit, various input information, results of various arithmetic operations, etc.; and a storage device 5 storing various application programs including the control programs, various music piece data, various other data, etc. The embodiment of the electronic musical instrument further includes: a display device 6 including, for example, an LCD (Liquid Crystal Display) and LEDs (Light Emitting Diodes); a communication interface (IN) 7 connectable with an external device 100, such as an MIDI (Musical Instrument Digital Interface) device, to communicate data with the external device 100; a tone generator circuit 8 for converting, into tone signals, performance information input via the performance operator unit, performance information obtained by reproducing any of the music piece data stored in the storage device 5; an effect circuit 9 for imparting various effects to tone signals output from the tone generator circuit 8; and a sound system 10 including, for example, a DAC (Digital-to-Analog Converter), amplifier and speaker for converting tone signals output from the circuit 9 into audible sounds.

The aforementioned components 1 to 9 are interconnected via a bus 11. The external device 100 is connected to the communication I/F 7, the effect circuit 9 is connected to the tone generator circuit 8, and the sound system 10 is connected to the effect circuit 9.

The storage device 5 comprises, for example, a storage medium, such as a flexible disk (FD), hard disk (HD), CD-ROM, DVD (Digital Versatile Disk), MO (Magneto-Optical) disk and semiconductor memory, and a drive device for driving the storage medium. The storage medium may be detachably attachable to the drive device, or the storage deice 5 itself may be detachably attachable to the embodiment of the electronic musical instrument. Alternatively, neither the storage medium nor the storage device 5 may be detachably attachable. The storage device 5 (more specifically the storage medium) too can store the control programs for execution by the CPU 2, and thus, in a case where any of the control programs is not prestored in the ROM 3, the control program may be stored in the storage device 5 so that the CPU 2 is allowed to behave in the same manner as in the case where the control program is prestored in the ROM 3. In this way, addition, version upgrade, etc. of desired control programs can be facilitated.

Although the external device 100 is connected to the communication IT 7 in the illustrated example of FIG. 1, the present invention is not so limited, and, for example, a server computer may be connected to the communication I/F 7 via a LAN (Local Area Network) and the Internet, or via a communication network like a telephone network. In such a case, if any of the above-mentioned programs and parameters is not stored in the storage device 5, the communication I/F 7 may be used to download the program and parameters from the server computer. The electronic musical instrument, which is a client, transmits a command, requesting downloading of the program and parameters, to the server computer via the communication I/F 7 and the communication network. Upon receipt of the command, the server computer delivers the requested program and parameters to the electronic musical instrument via the communication network. Then, the electronic musical instrument receives the program and parameters via the communication I/F 7 and stores the received program and parameters into the storage device 5, and thus, the downloading is completed.

Note that, as seen from the above-described construction, the instant embodiment of the electronic musical instrument may be built on a general-purpose personal computer, having a keyboard externally connected thereto, rather than being built on an electronic keyboard instrument.

Further, in the case where the instant embodiment of the electronic musical instrument is built on an electronic keyboard instrument, the aforementioned storage device 5, display device 6 and communication I/F 7 (as well as the external device 100) are not essential to the present invention and thus may be dispensed with. This is why the components 5 to 7 (as well as the external device 100) are depicted by broken line in FIG. 1.

Figure 2:
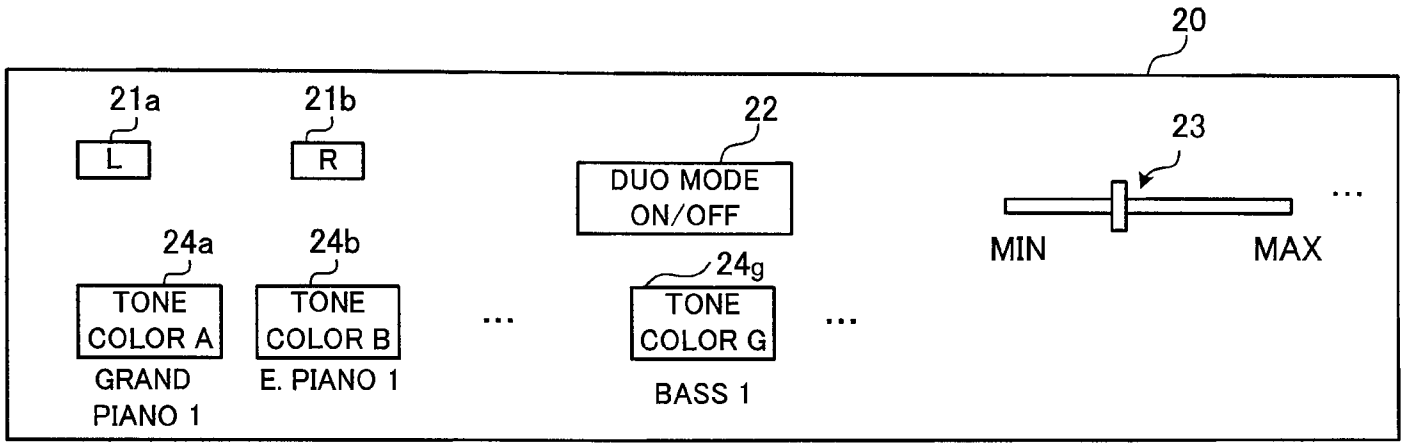
FIG. 2 is a plan view showing an example outer appearance of an operation panel provided in an input operation section of the electronic musical instrument shown in FIG. 1.

FIG. 2 is a schematic plan view showing an example outer appearance of an operation panel 20 included in the input operation section 1. As shown in the figure, a plurality of switches 21 to 24 are provided on the operation panel 20 for a user to make various settings.

Of the plurality of switches, a left-key-range designating switch (hereinafter referred to also as "L switch") 21*a* is operable by the user to designate a left key range of the keyboard in a case where the keyboard is divided into a plurality of, i.e. left and right, key ranges, and a right-key-range designating switch (hereinafter referred to also as "R switch") 21*b* is operable by the user to designate the right key range. These key-range designating switches 21*a* and 21*b* constitute a key range designation section adapted to individually designate a desired one of the plurality of, i.e. left and right, key ranges.

A duo mode switch 22 is operable to switch between a selected state (i.e., ON state) and a cancelled state (i.e., OFF state) of a duo mode. Note that the duo mode is a mode selected when one keyboard is played duet. Let it be assumed here that, in the instant embodiment, switching is made between the ON and OFF states of the duo mode in a toggle-like fashion each time the duo mode switch 22 is depressed. Needless to say, there may be provided separate switches for designating the ON state and OFF states, respectively, of the duo mode. Note that the "duo mode" is a mode selected when two persons (human players) want to play the single keyboard duet.

Further, a volume slider 23 is a tone volume designating operator operable to designate a master tone volume. Whereas, in the instant embodiment, the slider-type operator is employed as the tone volume designating operator, the present invention is not so limited, and a rotary-type operator may be employed as the tone volume designating operator.

Tone color designating switches 24*a*, 24*b*, 24*g* are operable to designate tone colors A, B, . . . , G, respectively. In the illustrated example, "Grand Piano", "E. Piano", . . . , "Bass 1" are assigned as tone colors A, B, . . . , G, respectively. Although it is assumed here for simplicity of description that the tone color assignment is fixed, the present invention is not so limited, and it may be changed freely as desired by the user.

Note that, in the case where the display device 6 is dispensed with as noted above, respective operating states of the switches 21 to 24 cannot be known, and thus, LEDs are preferably provided near some or all of the switches 21 to 24 in order to inform the user of the respective operating states of the switches 21 to 24. Such LEDs may be provided even in the case where the display device 6 is provided. Further, in the case where the display device 6 is dispensed with, a small-size LCD may be provided on the operation panel 20. This is because, if the current operation mode and various selected items are displayed on the LCD, it is possible to operate the electronic musical instrument with an increased ease.

Outline of control processing performed by the electronic musical instrument constructed in the above-described manner will be discussed below with reference to FIGS. 2 and 3, and details of the control processing will be discussed with reference to FIGS. 4 to 7.

The instant embodiment of the electronic musical instrument has the following operation modes: (A) normal performance mode; (B) split mode; and (C) duo mode. The "normal performance mode" is a mode selected where the user wants to perform the keyboard in an ordinary or normal manner without the keyboard being divided into a plurality of key ranges (two, L and R key ranges in the instant embodiment). The "split mode" is a mode selected where the user wants to perform the keyboard with the keyboard divided into a plurality of key ranges and with different pitch ranges (particularly, different octaves) and different tone colors allocated to individual ones of the plurality of key ranges. The "duo mode" is a mode selected when two human players want to play the single keyboard duet, as noted above. There may be employed other operation modes than the aforementioned normal performance mode, split mode and duo mode, such as a setting mode for making various settings and a music piece reproduction mode for reproducing music piece data, but these other operation modes are not essential to the present invention and thus will not be described here.

The keyboard included in the input operation section 1 in the instant embodiment is one having 76 (seventy-six) keys from the lowest pitch "A-1" to the highest-pitch "C7" that correspond to note numbers "33" and "108", respectively, according to the SMF (Standard MIDI File) format; note however, the middle C is "C3" that corresponds to note number "60". In the illustrated example, default tone colors are determined in advance as follows. Namely, when the normal performance mode is selected, "tone color A", more specifically "GRAND PIANO 1", allocated to the tone color designating switch 24*a*, is set by default as a tone color (i.e., as a default tone color) for the entire key range of the keyboard. When the split mode is selected, "tone color G", more specifically "BASS 1", allocated to the tone color designating switch 24*g*, is set by default as a tone color (i.e., as a default tone color) for the L key range of the keyboard (hereinafter referred to as "second tone color in the split mode"). Further, in the instant embodiment, when the duo mode is selected, the split point is set as a fixed value, more specifically "E3" that becomes the highest pitch in the divided L key range, as will be later described. Further, in such a case, the octaves of the divided L and R key ranges are changed to "+2" and "−2", respectively, Let it also be assumed that, in each of the split mode and the duo mode, no gap ("0") is set between the divided L and R key ranges.

Figure 3:
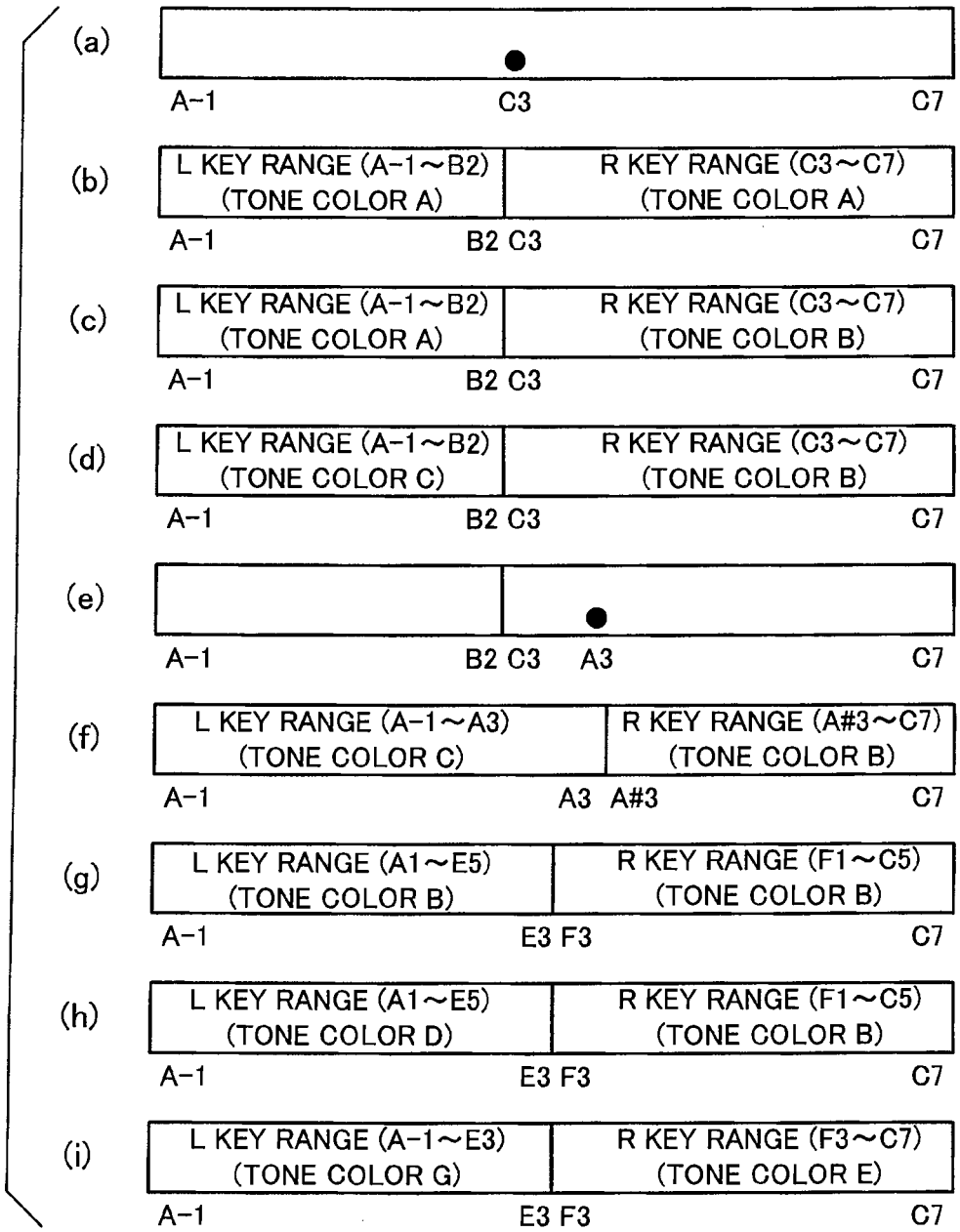
FIG. 3 is a diagram showing example states of a keyboard before and after key range division in the electronic musical instrument shown in FIG. 1.

FIG. 3 is a diagram showing example states of the keyboard before and after key range division. In the figure, parenthesized pitch ranges in the L and R key ranges represent tone pitch ranges of the L and R key ranges; for example, "(A1-E5)" in (g) of FIG. 3 represents a tone pitch range of the L key range.

As shown in (a) of FIG. 3, once the user turns on (i.e., depresses) a key of "C3" (indicated by "●" in (a) of FIG. 3) while simultaneously turning on the R switch 21*b*, the operation mode shifts to the split mode, where "C3" is set as the lowest-pitch note (lowest tone pitch) of the R key range while "B2" adjoining "C3" in a lower (i.e., high-to-low) pitch direction is set as the highest-pitch note (highest tone pitch or highest pitch) of the L key range. Namely, in this case, the R key range changes to extend from the "C3" key to the "C7" key while the L key range changes to extend from the "A-1" key to the "B2" key. Further, in this case, the default tone color in the normal performance mode, i.e. "tone color A", is left set for the L and R key ranges; namely, the default tone color in the normal performance mode is left unchanged despite the shift from the normal performance mode to the split mode.

Further, once the user turns on the tone color designating switch 24*b* while simultaneously turning on the R switch 21*b*, the tone color of the R key range ("tone color A" in (b) of FIG. 3) is changed to "tone color B", more specifically "E. PIANO 1", allocated to the tone color designating switch 24*b*, as shown in (c) of FIG. 3. Further, once the user turns on the tone color designating switch 24*c* while simultaneously turning on the L switch 21*b*, the tone color of the L key range ("tone color A" in (c) of FIG. 3) is changed to "tone color C" allocated to the tone color designating switch 24*c*, as shown in (d) of FIG. 3.

Furthermore, once the user turns on an "A3" key (indicated by "●" in (d) of FIG. 3) while simultaneously turning on the L switch 21*a*, the highest-pitch note (highest tone pitch) of the L key range ("B2" in (e) of FIG. 3) is changed to "A3" while the lowest-pitch note (lowest tone pitch or lowest pitch) of the R key range ("C3" in (e) of FIG. 3) is changed to "A#3", as shown in (f) of FIG. 3.

Then, once the user turns on the duo mode switch 22, the operation mode shifts from the split mode to the duo mode, and the key range of the keyboard is divided at a duo-mode point (fixed value, more specifically "E3") into the L and R key ranges in such a manner that the L key range extends from the "A-1" key to the "E3" key while the R key range extends from the "F3" key to the "C7" key. Whereas, in the instant embodiment, the duo-mode point "E3" is set as the highest-pitch note of the L key range, the present invention is of course not so limited, and the duo-mode point "E3" may be set as the lowest-pitch note (lowest tone pitch) of the R key range. Then, the tone color of the L key range is changed from "tone color C" to "tone color B" set for the R key range. Namely, "tone color B" is set for both of the tone colors of the L and R key ranges.

Furthermore, once the user turns on the tone color designating switch 24*d* while simultaneously turning on the L switch 21*a*, the tone color of the L key range ("tone color B" in (g) of FIG. 3) is changed to "tone color D" allocated to the tone color designating switch 24*d* as shown in (h) of FIG. 3 even when the duo mode is selected.

Then, once the user turns on the duo mode switch 22 in the state of (h) of FIG. 3 where the duo mode is selected, the duo mode is canceled, and the operation mode shifts to the normal performance mode. At that time, the current split point, i.e. "E3", is backed up or stored as the highest-pitch note of the L key range, and the entire key range is set at the tone color currently set for the R key range, i.e. "tone color B".

Then, once the user turns on the tone color designating switch 24*e* while simultaneously turning on the R switch 21*b*, the operation mode shifts from the normal operation mode to the split mode, where the backed-up pitch (i.e., tone pitch) "E3" is set as the highest-pitch note of the L key range while "F3" adjoining "E3" in a higher (i.e., low-to-high) pitch direction is set as the lowest-pitch note of the R key range. Namely, in this case, the L key range changes to extend from the "A-1" key to the "E3" key while the R key range changes to extend from the "F3" to "C7". At that time, the tone color of the R key range is changed to "tone color E" allocated to the tone color designating switch 24*e*, while the tone color of the L key range is changed to the second tone color in the split mode (in the instant embodiment, changed to "tone color G" (more specifically "BASS 1) allocated to the tone color designating switch 24*g*.

Once the user turns on the tone color designating switch 24*e* while simultaneously turning on the L switch 21*a* in place of the R switch 21*b*, the key range is divided into the L and R key ranges in the same manner as in (i) of FIG. 3; however, in this case, the tone color of the L key range is changed to "tone color E" allocated to the tone color designating switch 24*e*, while the tone color for the entire key range, i.e. "tone color B", is set as-is for the R key range.

Namely, in the instant embodiment, when the user wants to set a split point through tone pitch designating operation, such as key depression, and once the user designates a tone pitch while simultaneously turning on the L switch 21*a* in order to set a split point, the user-designated tone pitch is set as the highest-pitch note of the L key range. On the other hand, once the user designates a tone pitch while simultaneously turning on the R switch 21*b*, the designated tone pitch is set as the lowest-pitch note of the R key range. Thus, according to the instant embodiment, the user can set the split point while clearly knowing or grasping whether the user-designated tone pitch becomes the highest-pitch note of the L key range or the lowest-pitch note of the R key range. Further, according to the instant embodiment, the user is allowed to set a tone color for each of the divided key ranges by designating the L or R key range via the L or R switch 21*a* or 21*b*. Thus, the user can set a tone color for each of the divided key ranges with ease and intuitively. Therefore, the user only has to turn on the R switch 21*b* when it wants to set key ranges and tone colors focusing on the R key range, or only has to turn on the L switch 21*a* when it wants to set key ranges and tone colors focusing on the L key range. Namely, irrespective of whether the user sets key ranges and tone colors focusing on the R key range or focusing on the L key range, the key range setting and tone color setting can be performed with ease as desired by the user. Furthermore, because the user first designates a type of key range as an object of setting in the instant embodiment, it can become clear what (upper and lower limits of a key range etc.) are being set for which key range, and thus, user-intended setting can be performed reliably and easily. In addition, because the key range setting operation and tone color setting operation are integrated or interlinked in the instant embodiment, even a user who is not accustomed to setting operations can operate the electronic musical instrument with an utmost ease.

Now, a detailed description will be given about the control processing performed in the instant embodiment of the electronic musical instrument.

Figure 4A:
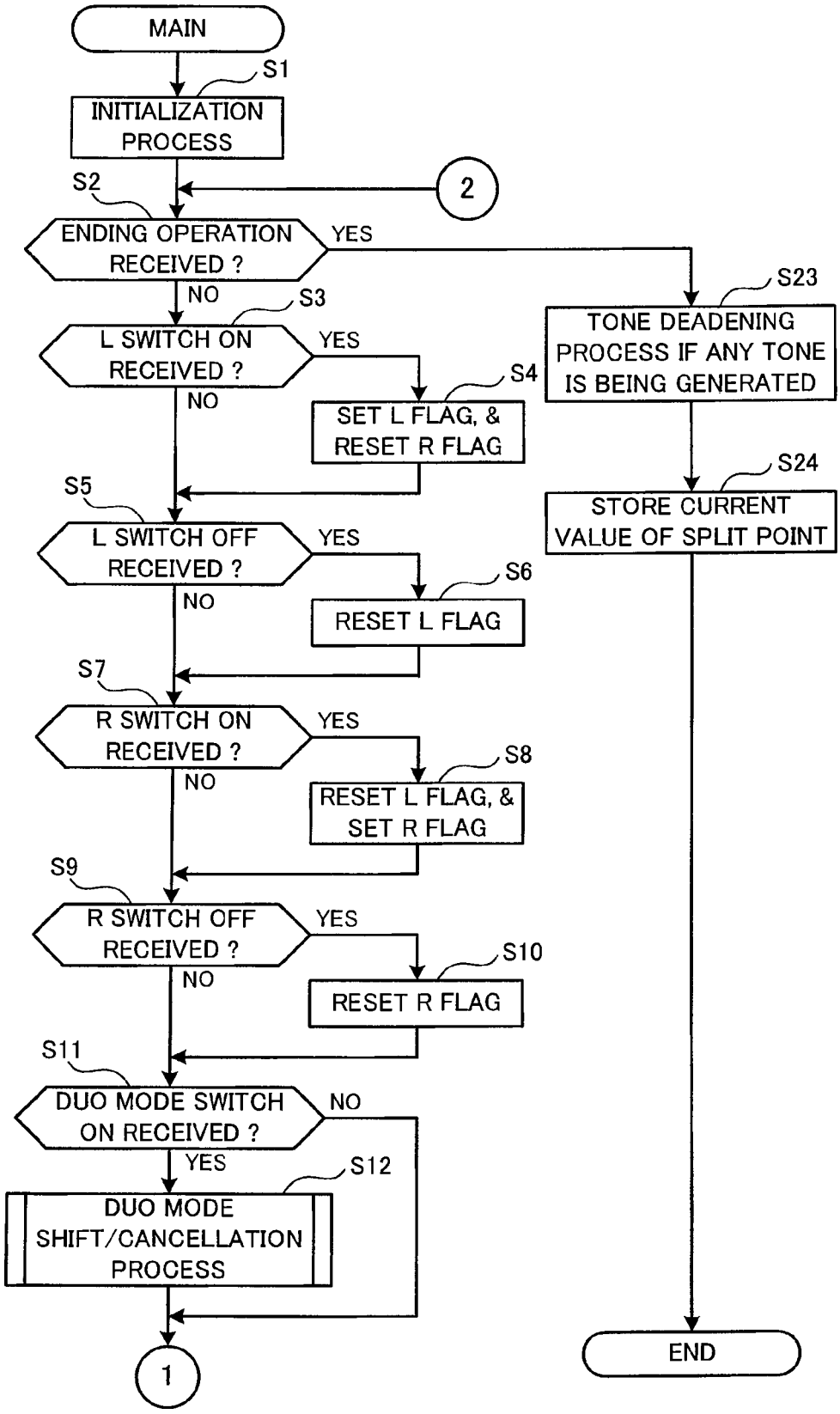
FIG. 4A is a flow chart showing a part of an example operational sequence of a main routine performed in the electronic musical instrument.
Figure 4B:
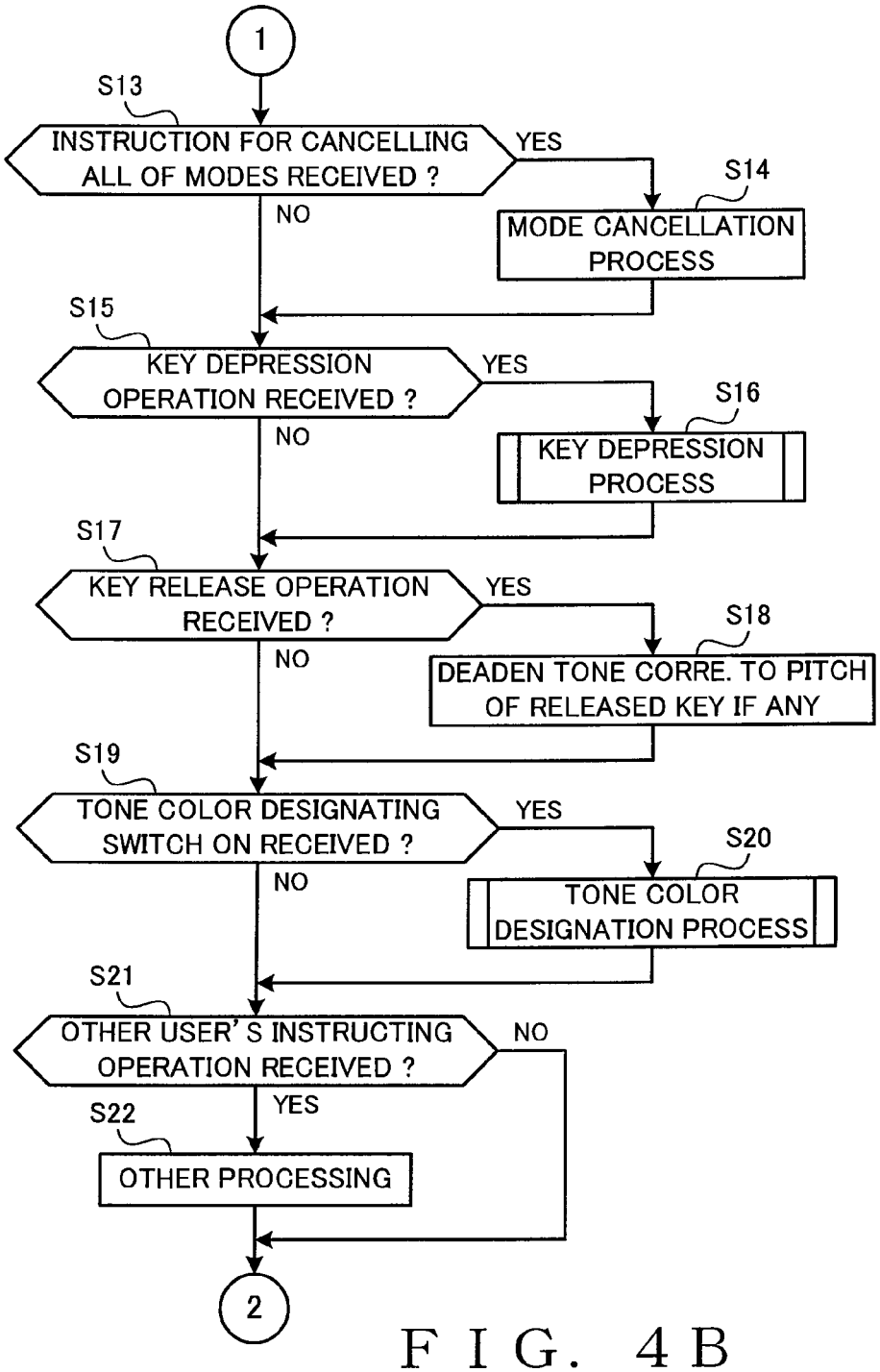
FIG. 4B is a flow chart showing the remaining part of the operational sequence of the main routine.

FIGS. 4A and 4*b* are a flow chart showing an example operational sequence of a main routine performed in the instant embodiment of the electronic musical instrument, more specifically by the CPU 2 of the electronic musical instrument. The main routine mainly comprises: (1) "initialization process" (step S1); (2) "L and R flag control process" (steps S3 to S10); (3) "duo mode shift/cancellation processing" (step S12); (4) "mode cancellation process" (step S14 of FIG. 4B); (5) "key depression process" (step S16); (6) "key release process" (step S18); (7) "tone color designation process" (step S20); (8) "other processing" (step S22); and (9) "end process" (steps S23 and S24 of FIG. 4A).

The main routine is started up, for example, in response to a power supply to the electronic musical instrument being turned on via a power supply switch (not shown) included in the input operation section 1. Following the start-up, the initialization process is executed once, followed by the (2) L and R flag control process, (3) duo mode shift/cancellation process, (4) mode cancellation process, (5) key depression process, (6) key release process, (7) tone color designation process and (8) other processing are performed. After that, the routine reverts to the (2) L and R flag control process of step S2, so that the L and R flag control process, duo mode shift/cancellation process, mode cancellation process, key depression process, key release process, tone color designation process and other processes are repetitively performed until the power supply switch is turned off via the power supply switch. The main routine may be in the form of application software, in which case it is started up in response to a user's start operation and ended in response to a user's end operation.

In the above-mentioned initialization process, the CPU 2 clears the RAM 4 and then sets various parameters as follows. Namely, the CPU 2 sets the split mode and duo mode to an OFF state; resets the L and R flags to value "0"; sets the split point to a value stored at the end of the last execution of the instant main routine (or to, for example, "F#2" (highest-pitch note of the L key range if the main routine has been started up for the first time and thus there is no split point value stored)); sets the tone color for the entire key range to a default tone color; sets the tone colors for the L and R key ranges to "none"; sets the highest-pitch note of the L key range to "none"; sets the lowest-pitch note of the L key range to "A-1" (lowest-pitch note of the keyboard); sets the highest-pitch note of the R key range to "C7" (highest-pitch note of the keyboard); and sets the lowest-pitch note of the R key range to "none". Note, however, that the above-mentioned parameters are just principal ones, not all, of various parameters employed in the instant embodiment.

The L flag is a flag that is set (to "1") in response to turning-on of the L switch 21*a* and reset (to "0") in response to turning-off of the L switch 21*a*. Similarly, the R flag is a flag that is set (to "1") in response to turning-on of the R switch 21*b* and reset (to "0") in response to turning-off of the R switch 21*b*. Each of the L and R switches 21*a* and 21*b* is maintained in the set state as long as the corresponding switch 21*a* or 21*b* is maintained in the ON state. The "set tone color for the entire key range" means a tone color set for the entire key range when the keyboard is not divided in a plurality of key ranges, such as when the normal performance mode is selected. The set tone colors for the L key range and R key range are tone colors set for the L key range and R key range, respectively, when the keyboard is divided in two, i.e. L and R, key ranges, such as when the split mode or duo mode is selected.

In the (2) L and R flag control process, the CPU 2 performs various operations including: (2-1) setting the L flag and resetting the R flag in response to turning-on of the L switch 21*a* (step S4); (2-2) resetting the L flag in response to turning-off of the L switch 21*a* (step S6); (2-3) resetting the L flag and setting the R flag in response to turning-on of the R switch 21*b* (step S8); and (2-4) resetting the R flag in response to turning-off of the R switch 21*b* (step S10). However, if the ON/OFF states of the R switch 21*b* and L flag have not changed, the CPU 2 proceeds to step S11 without performing control of the L and R flags. Note that, because the instant embodiment does not assume a case where both of the L switch 21*a* and the R switch 21*b* are turned on simultaneously, no processing (including an inhibition process) responsive to such simultaneous turning-on of the L and R switches 21*a* and 21*b* in included in the main routine.

At step S11, the CPU 2 determines whether or not the duo mode switch 22 has been turned on. If the duo mode switch 22 has been turned on, i.e. a turning-on operation of the duo mode switch 22 has been received, as determined at step S11 (i.e., YES determination at step S11), the CPU 2 performs the (3) duo mode shift/cancellation process at step S12. If, on the other hand, the duo mode switch 22 has not been turned on, at step S11 (i.e., NO determination at step S11), the CPU 2 skips step S12 to move to step S13 of FIG. 4B.

Figure 5:
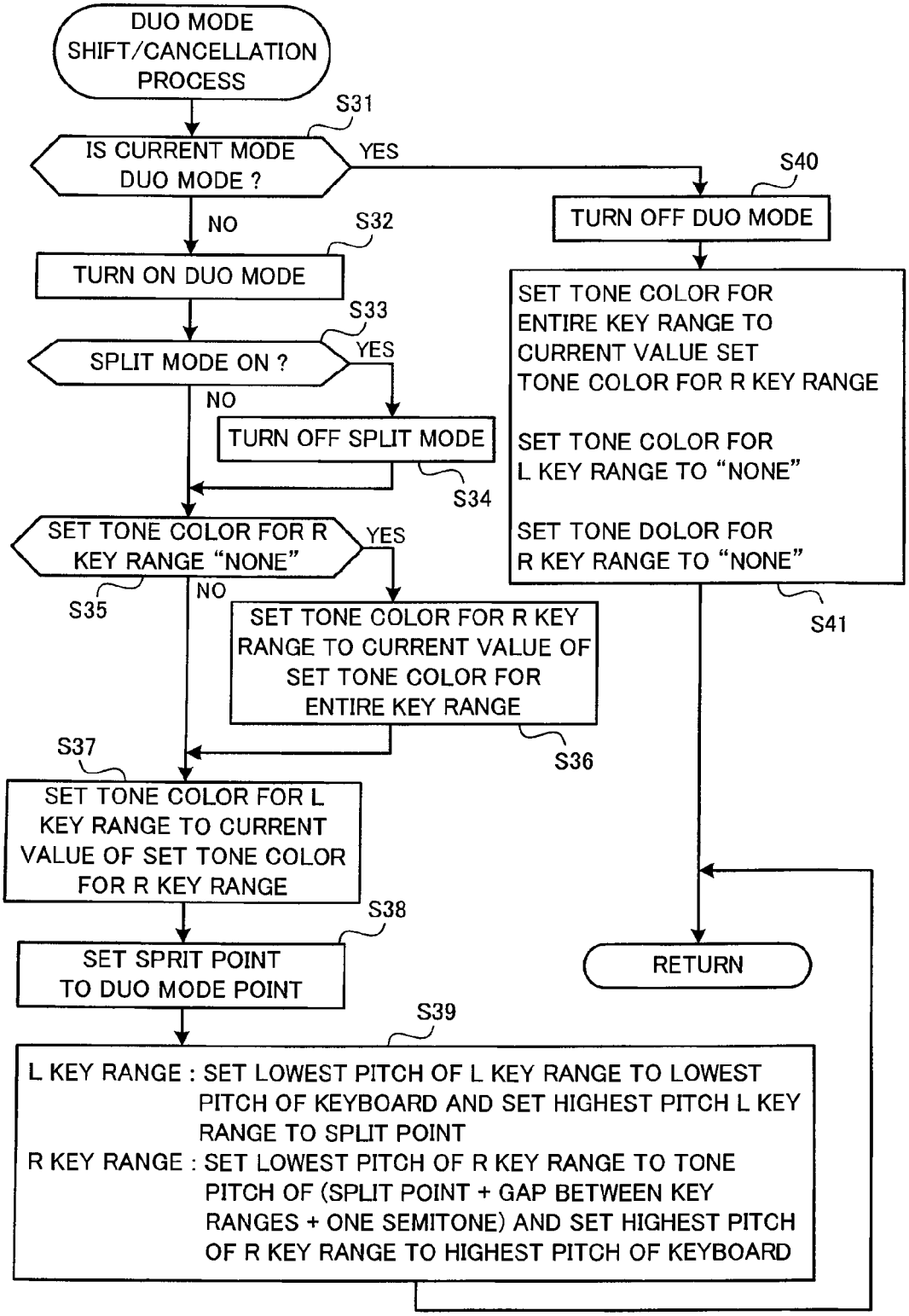
FIG. 5 is a flow chart showing an example detailed operational sequence of a duo mode shift/cancellation process shown in FIG. 4A.

FIG. 5 is a flow chart showing an example detailed operational sequence of the (3) "duo mode shift/cancellation process". The (3) "duo mode shift/cancellation process" comprises (3-1) a due mode shift process (steps S32 to S39), and (3-2) a duo mode cancellation process (steps S40 and S41).

Once the (3) "duo mode shift/cancellation process" is started, the CPU 2 determines, at step S31, whether or not the current operation mode is the duo mode. If the current operation mode is not the duo mode as determined at step S31 (NO determination at step S31), the CPU 2 proceeds to the (3-1) "duo mode shift process", while, if the current operation mode is the duo mode (YES determination at step S31), the CPU 2 goes to the (3-2) "duo mode cancellation process".

In the "duo mode shift process", the CPU 2 first turns on the duo mode to shift the operation mode to the duo mode at step S32. Then, the CPU 2 determines, at step S33, whether or not the current operation mode is the split mode. If the current operation mode is the split mode as determined at step S33 (YES determination at step S33), the CPU 2 turns off the split mode at step S34 and then goes to step S35. If, on the other hand, the current operation mode is not the split mode (NO determination at step S33), the CPU 2 proceeds to step S35.

At step S35, the CPU 2 determines whether or not the set tone color for the R key range is currently "none". If the set tone color for the R key range is currently "none" (YES determination at step S35), the current value of the set tone color for the entire key range is set as the tone color for the R key range at step S36 and also set as the tone color for the L key range at step S37. Namely, the same set tone color for the entire key range is set for both of the R and L key ranges. It should be noted that the current values of the respective set tone colors of the respective key ranges are stored in the RAM 4.

If, on the other hand, the tone color for the R key range is currently "set" as determined at step S35, the CPU 2 proceeds to step S37, where the current value of the set tone color for the R key range is set as the tone color for the L key range.

At next step S38, the CPU 2 sets the split point at the above-mentioned duo mode point ("E3"). Then, at step S39, the CPU 2 sets the L key range to a range from the lowest-pitch note "A-1" to the duo mode point "E3" and sets the R key range to a range from a tone pitch of [the duo mode point "E3"+ gap between the key ranges (in the instant embodiment, "0"+ one semitone)] to the highest-pitch note "C7", after which the (3) "duo mode shift/cancellation process" is brought to an end.

Further, once the user turns on the duo mode switch 22 in the split-mode keyboard state shown in (f) of FIG. 3, the CPU 2 first turns on the duo mode at step S32 and then turns off the split mode (i.e., sets the split mode in the ON state) at step S34 because the current operation mode is the split mode. Further, because the set tone color for the R key range is currently "tone color B", the CPU 2 sets the current value of the set tone color for the R key range, i.e. "tone color B", is set for the L key range at step S37, and the duo mode point, i.e. "E3", is set as the split point at step S38. Lastly, the CPU 2 sets the L and R key ranges through the aforementioned operation of step S39. As a consequence, the operation mode shifts from the split mode to the duo mode, and the keyboard state changes to the state shown in (g) of FIG. 3 where the L and R key ranges are set to a range from "A-1" to "E3" and a range from "F3" to "C7", respectively, and the tone color for the L key range is set at "tone color B".

In the (3-2) "duo mode cancellation process", on the other hand, the CPU 2 first turns off the duo mode (i.e., sets the duo mode in the OFF state) to cancel the duo mode at step S40. Then, the CPU 2 sets the current value of the set tone color for the R key range as the set tone color for the entire key range and then sets "none" as each of the set tone colors for the L and R key ranges at step S41, after which the CPU 2 terminates the (3) "duo mode shift/cancellation process". Although the highest-pitch note of the L key range and the lowest-pitch note of the R key range set when the operation mode shifted to the duo mode (see step S39) are not used in operations following the cancellation of the duo mode, an operation for setting each of the highest-pitch note of the L key range and the lowest-pitch note of the R key range to "none" may be added into the (3-2) "duo mode cancellation process" just to make sure.

Referring back to FIG. 4B, the CPU 2 determines, at step S13, whether or not an instruction for cancelling all of the operation modes has been received. If such an instruction for cancelling all of the operation modes has been received (YES determination at step S13), the CPU 2 performs the (4) "mode cancellation process" at step S14. If, on the other hand, the instruction for cancelling all of the operation modes has not been received (NO determination at step S13), the CPU 2 proceeds to step S15. Among examples of the instruction for cancelling all of the operation modes is an instruction for shifting to the music piece reproduction mode and a reset instruction based on a combination of operations of predetermined switches.

In the (4) "mode cancellation process", (4-1)

(4-1a) if the split mode is currently ON, the CPU 2 turns off the split mode and then goes to a (4-2) step below, (4-1b) if the split mode is currently OFF, on the other hand, the CPU 2 goes directly to the (4-2) step below, (4-2)

(4-2a) if the duo mode is currently ON, the CPU 2 turns off the duo mode and goes to a (4-3) step below, (4-2b) if the duo mode is currently OFF, the CPU 2 goes directly to the (4-3), and (4-3) the CPU 2 sets the current value of the tone color for the R key range as the set tone color for the entire key range and sets each of the tone colors set for the L and R key ranges to "none".

Note that the operation of the (4-3) step is the same as the operation of step S41 of FIG. 5. Also note that an operation for setting each of the highest-pitch note of the L key range and the lowest-pitch note of the R key range to "none" may be added into the (4) "mode cancellation process" as in the case of the (3-2) "duo mode cancellation process".

Further, at step S15, the CPU 2 determines whether or not any key depression operation has been received (i.e. whether or not any one of the keys has been depressed on the keyboard). If any key depression operation has been received (YES determination at step S15), the CPU 2 performs the (5) "key depression process" at step S16, but, if no key depression operation has been received (NO determination at step S15), the CPU 2 proceeds to step S17.

Figure 6A:
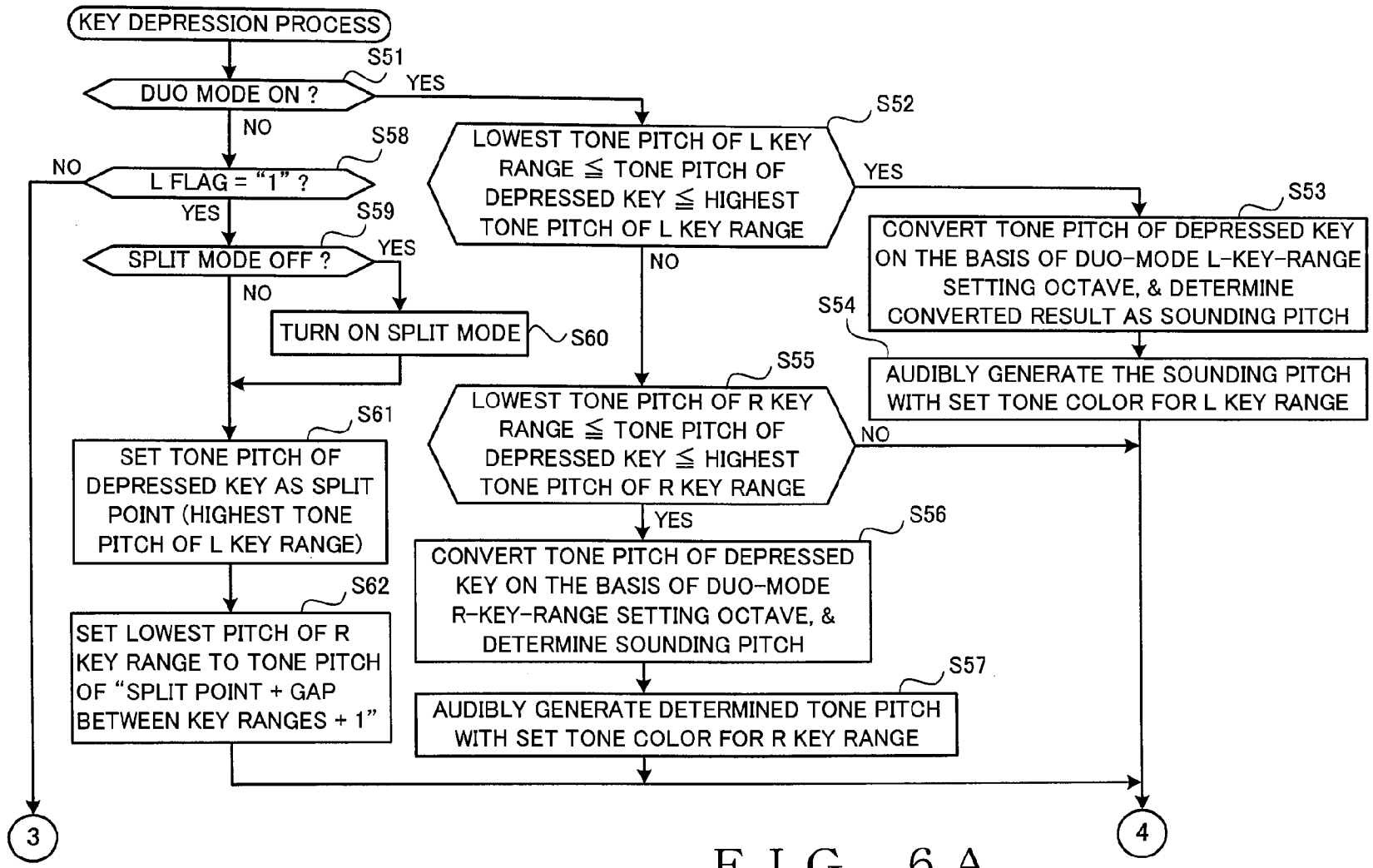
FIG. 6A is a flow chart showing a part of an example detailed operational sequence of a key depression process shown in FIG. 4B.
Figure 6B:
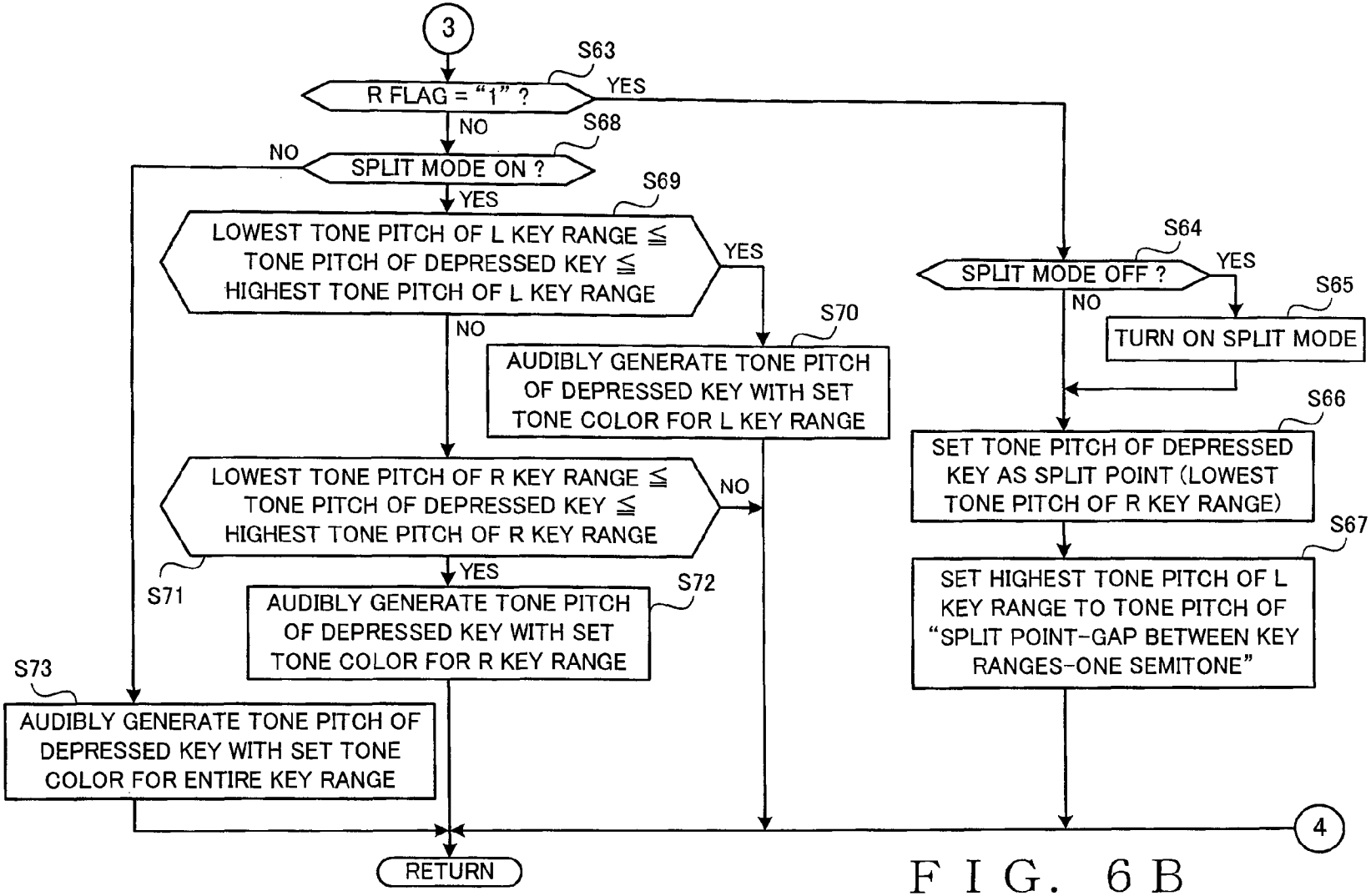
FIG. 6B is a flow chart showing the remaining part of the operational sequence of the key depression process.

FIGS. 6A and 6B are a flow chart showing an example detailed operational sequence of the (5) "key depression process". The (5) "key depression process" generally comprises: (5-1) key depression process in the duo mode (steps S52 to S57); and (5-2) key depression process in a non-duo mode (steps S58 to S73). Further, the (5-2) key depression process in the non-duo mode comprises: (5-2a) key depression process with the L switch 21*a* in the ON state (steps S59 to S62); (5-2b) key depression process with the R switch 21*b* in the ON state (steps S64 to S67); and (5-2c) other key depression process (steps S68 to S73).

Once the (5) "key depression process" is started, the CPU 2 first determines, at step S51, whether or not the duo mode is currently selected (currently ON). If the duo mode is currently selected (currently ON) (YES determination at step S51), the CPU 2 goes to the (5-1) "key depression process in the duo mode", but, if the duo mode is not currently selected (NO determination at step S51), the CPU 2 proceeds to the (5-2) "key depression process in the non-duo mode".

In the (5-1) "key depression process in the duo mode", the CPU 2 determines, at step S52, whether the tone pitch of the depressed key (i.e., user-designated key position) is within the L key range, i.e. whether a condition of "the lowest-pitch note of the L key range≤the tone pitch of the depressed key≤the highest-pitch note of the L key range" is satisfied. If the tone pitch of the depressed key is within the L key range (YES determination at step S52), the CPU 2 shifts (converts) the tone pitch of the depressed key by a duo-mode L-key-range setting octave and determines the thus-shifted (converted) tone pitch as a sounding pitch, at step S53. Then, the CPU 2 instructs the tone generator circuit 8 to audibly generate or sound the determined sounding pitch with the set tone color for the L key range, at step S54. Because the duo-mode L-key-range setting octave is fixed at "+2" in the instant embodiment, the tone pitch of the depressed key is shifted by "+2" octaves. Note, however, that, because the tone color for the L key range is not fixed unlike the duo-mode L-key-range setting octave, the current tone color setting value (tone color value) of the L key range is read out and supplied to the tone generator circuit 8. Because the reason why the duo-mode L-key-range setting octave is fixed and not freely changeable by the user is to solely simplify the description, the duo-mode L-key-range setting octave may be made freely changeable by the user.

If, on the other hand, the tone pitch of the depressed key is not within the L key range (NO determination at step S52), the CPU 2 further determines, at step S55, whether the tone pitch of the depressed key is within the R key range, i.e. whether a condition of "the lowest-pitch note of the R key range≤the tone pitch of the depressed key≤the highest-pitch note of the R key range" is satisfied. If the tone pitch of the depressed key is within the R key range (YES determination at step S55), the CPU 2 shifts (converted) the tone pitch of the depressed key by a duo-mode R-key-range setting octave and determines the thus-shifted (converted) tone pitch as a sounding pitch, at step S56. Then, the CPU 2 instructs the tone generator circuit 8 to audibly generate or sound the determined sounding pitch with the set tone color for the R key range, at step S57. Because the duo-mode R-key-range setting octave is fixed at "−2" in the instant embodiment, the tone pitch of the depressed key is shifted by "−2" octaves. Note, however, that, because the tone color for the R key range is not fixed unlike the duo-mode R-key-range setting octave, the current tone color setting value (tone color value) of the R key range is read out and supplied to the tone generator circuit 8. The duo-mode R-key-range setting octave too may be made freely changeable by the user.

If, on the other hand, the tone pitch of the depressed key (i.e., user-designated key position) is not within the R key range (NO determination at step S55), the CPU 2 terminates the (5-1) "key depression process in the duo mode" and further terminates the (5) "key depression process" as well.

As apparent from the foregoing, the arrangements for implementing the operations of steps S53, S56, etc. via the CPU 2 correspond to, or constitute, a tone pitch adjustment section which, when the keyboard is used in a divided usage state where it is usable divided in predetermined two key ranges (i.e., when the operation mode is the due mode), makes adjustment such that at least a portion of a pitch range of tones generatable in association with the individual key ranges (i.e., pitch range portion from "A1" to "C5" in the above-described example) is sharable between the predetermined two key ranges.

Once the process proceeds from step S51 to the (5-2) "non-duo-mode key depression process", the CPU 2 first determines, at step S58, whether the L flag is currently in the set state (="1"). If the L flag is currently in the set state (="1") (YES determination at step S58), the CPU 2 proceeds to the (5-2a) "key depression process with the L switch 21*a* in the ON state".

In the (5-2a) "key depression process with the L switch 21*a* in the ON state", if the current operation mode is not the split mode, the CPU 2 turns on the split mode (i.e., sets the split mode in the ON state) to shift to the split mode (step S59→S60) and then proceeds to step S61.

At step S61, the CPU 2 sets the tone pitch of the depressed key (i.e., user-designated key position) as the split point, i.e. the highest-pitch note of the L key range (namely, the upper-limit key of the L key range). Information of the thus-set highest-pitch note of the L key range is stored into the RAM 4 as information (boundary information) indicative of the user-set key position at a boundary (i.e., boundary key position) of the L key range. Namely, the boundary information related to key range division includes information indicative of a type of the key range (L key range in this case) and information indicative of the key position at the boundary (boundary key position) of the key range (i.e., upper-limit key of the key range). Thus, an actual key range corresponding to the user-designated key range type (L key range) (i.e., first actual key range) is determined on the basis of the key position at the desired boundary designated by the user in association with the user-designated key range type (L key range). Therefore, the above-mentioned RAM 4 corresponds to a storage section that stores boundary information in accordance with which the keyboard is used divided in a plurality of key ranges. Then, at step S62, the CPU 2 automatically sets, as the lowest-pitch note of the R key range (i.e., lower-limit key of the R key range having not been designated by the user), a key position corresponding to a tone pitch of "split point+gap between the key ranges (in the instant embodiment, "0" (none))+one semitone" and automatically determines an actual key range of the R key range having not been designated by the user (i.e., second actual key range). After that, the CPU 2 terminates the (5-2a) "key depression process with the L switch 21*a* in the ON state" and then terminates the (5) "key depression process" as well.

Once the user depresses a key of "A3" while simultaneously turning on the L switch 21*a* in the split-mode keyboard state shown in (d) of FIG. 3 as shown in (e) of FIG. 3, the CPU 2 sets the tone pitch "A3" of the depressed key as the split point (highest-pitch note of the L key range) at step S61 and sets, as the lowest-pitch note of the R key range, a tone pitch one semitone higher than the split point (because no gap is provided between the L and R key ranges in the instant embodiment) at step S62, because the current operation mode is the split mode, not the duo mode, and the L flag is currently set at "1" (L flag="1"). As a consequence, the keyboard state changes to the state shown in (f) of FIG. 3 where the L and R key ranges are set to a range from "A-1" to "A-3" and a range from "A#3" to "C7", respectively, with the operation mode and the allocated tone colors of the L and R key ranges left unchanged.

If, on the other hand, the L flag is currently "0" (NO determination at step S58), the CPU 2 determines, at step S63 of FIG. 6B, whether the R flag is in the set state (R flag="1"). If the R flag is in the set state (R flag="1") (YES determination at step S63), the CPU 2 proceeds to the (5-2b) "key depression process with the R switch 21*b* in the ON state".

In the (5-2b) "key depression process with the R switch 21*b* in the ON state", if the current operation mode is not the split mode, the CPU 2 turns on the split mode to shift to the split mode (step S64→step S65) and then proceeds to step S66. If, on the other hand, the current operation mode is the split mode, the CPU 2 proceeds to step S66.

At step S66, the CPU 2 sets the tone pitch of the depressed key (i.e., user-designated key position) as the split point, i.e. the lowest-pitch note of the R key range (namely, the lower-limit key of the R key range). Information of the thus-set lowest-pitch note of the R key range is stored into the RAM 4 as information (boundary information) indicative of the user-set key position at a boundary (i.e., boundary key position) of the R key range. Namely, the boundary information related to key range division includes information indicative of a type of the key range (R key range in this case) and information indicative of the key position at the boundary of the key range (i.e., lower-limit key of the key range). Thus, an actual key range corresponding to the user-designated key range type (R key range) (i.e., first actual key range) is determined on the basis of the key position at the desired boundary designated by the user in association with the user-designated key range type (R key range). Then, the CPU 2 automatically sets, as the highest-pitch note of the L key range (i.e., upper-limit key of the L key range having not been designated by the user), a key position corresponding to a tone pitch of "split point−gap between the key ranges (in the instant embodiment, "0" (none))−one semitone)" and then automatically determines an actual key range of the L key range having not been designated by the user (i.e., second actual key range). After that, the CPU 2 terminates the (5-2b) "key depression process with the R switch 21*b* in the ON state" and then terminates the (5) "key depression process" as well.

As apparent from the foregoing, the arrangements for implementing the operations of step S15, steps S58 to S61, steps S63 to S66, etc. via the CPU 2 correspond to a key range determination section adapted to, in response to designation of a key range by the key range designation section (21*a* and 21*b*), receive information designating a boundary key position and determine an actual key range of the designated key range in accordance with the received boundary key position. Note that the operation of step S15 for determining whether or not any key depression operation has been received corresponds to receiving the information designating a boundary key position. Further, the operations of steps S61 and S66 for handling key depression information, received at step S15, as an upper-limited key or lower-limit key of the designated (L or R) key range corresponds to receiving information designating a key position of at least one of the upper and lower limits of the designated key range.

Further, the arrangements for implementing the operations of steps S62, S67, etc. via the CPU 2 correspond to automatically determining, in accordance with a first actual key range determined in association with the designated key range, a second actual key range corresponding to at least one other key range having not been designated by the key rage designation section. Furthermore, the arrangements for implementing the operations of steps S62 and S67 to set the gap between the key ranges at value "0" ("none") or other suitable value equal to or greater than "1" correspond to automatically determining the second actual key range corresponding to the at least one other key range such that the second actual key range is located adjacent to but spaced, by a predetermined number of keys ("0" or other suitable value equal to or greater than "1"), from the first actual key range determined in association with the designated key range. Stated otherwise, setting the gap between the key ranges at "0" (none) at steps S62 and S67 corresponds to automatically determining the second actual key range corresponding to the at least one other key range such that the second actual key range is located adjacent to the first actual key range determined in association with the designated key range.

Furthermore, the arrangements for implementing the operations of steps S15, S61, S66, etc. via the CPU 2 correspond to an update section that, once information designating a boundary key position is received in association with designation of a key range by the key range designation section in the split mode where the keyboard is set in the divided usage state where the keyboard is usable divided in a plurality of key ranges, updates the boundary information stored in the storage section (RAM 4) on the basis of the designated key range and the boundary key position indicated by the received information.

Once the user depresses a key of "C3" while simultaneously turning on the R switch 21*b* in the normal performance mode keyboard state as shown in (a) of FIG. 3, the CPU 2 sets the depressed tone pitch "C3" as the split point (lowest-pitch note of the R key range) at step S66 and sets, as the highest-pitch note of the L key range, a tone pitch one semitone lower than the split point (because no gap is provided between the L and R key ranges in the instant embodiment) at step S67, because the current operation mode is the normal performance mode, not the duo mode, and the R flag is currently set at "1". As a consequence, the keyboard state changes to the state shown in (a) of FIG. 3 where the L and R key ranges are set to a range from "A-1" to "B2" and a range from "C3" to "C7", respectively, with the operation mode and the allocated tone colors of the L and R key ranges left unchanged.

If, on the other hand, the R flag="0" (NO determination at step S63), the CPU 2 proceeds to the (5-2c) "other key depression process".

In the (5-2c) "other key depression process", the CPU 2 determines, at step S69, whether or not the current operation mode is the split mode. If the current operation mode is the split mode (YES determination at step S68), the CPU 2 goes to step S69. If, on the other hand, the current operation mode is not the split mode (NO determination at step S68), the CPU 2 proceeds to step S73.

At step S69, the CPU 2 determines whether the tone pitch of the depressed key is within the L key range, i.e. whether a condition of "the lowest-pitch note of the L key range≤the tone pitch of the depressed key≤the highest-pitch note of the L key range" is satisfied. If the tone pitch of the depressed key is within the L key range (YES determination at step S69), the CPU 2 instructs the tone generator circuit 8 to audibly generate the tone pitch with the set tone color for the L key range at step S70, then terminates the (5-2c) "other key depression process" and then terminates the (5) "key depression process" as well.

If the tone pitch of the depressed key is not within the L key range (NO determination at step S69), the CPU 2 further determines, at step S71, whether the tone pitch of the depressed key is within the R key range, i.e. whether a condition of "the lowest-pitch note of the R key range≤the tone pitch of the depressed key≤the highest-pitch note of the R key range" is satisfied. If the tone pitch of the depressed key is within the R key range (YES determination at step S71), the CPU 2 instructs the tone generator circuit 8 to audibly generate the tone pitch with the set tone color for the R key range at step S72, then terminates the (5-2c) "other key depression process" and then terminates the (5) "key depression process" as well.

If, on the other hand, the tone pitch of the depressed key is not within the R key range (NO determination at step S71), the CPU 2 terminates the (5-2c) "other key depression process" and further terminates the (5) "key depression process" as well.

At step S73, the CPU 2 instructs the tone generator circuit 8 to audibly generate the tone pitch with the set tone color for the entire key range, then terminates the (5-2c) "other key depression process" and then terminates the (5) "key depression process" as well.

As apparent from the foregoing, the arrangements for implementing the operations of steps S52 to S57, steps S69 to S72, etc. via the CPU 2 correspond to a key range division setting section that, on the basis of the actual key ranges determined by the key range determination section (S15, S58 to S61, S63 to S66, etc.), sets the keyboard into the divided usage state where the keyboard is usable divided in a plurality of key ranges.

Referring back to FIG. 4B, the CPU 2 determines, at step S17, whether any user's key release operation has been received. If any user's key release operation has been received (YES determination at step S17), the CPU 2 performs the (6) "key release process" at step S18, while, if no user's key release operation has been received (NO determination at step S17), the CPU 2 goes to step S19.

In the (6) "key release process", if a tone corresponding to the tone pitch of the released key is being currently audibly generated, the CPU 2 deadens the tone at step S18.

At step S19, the CPU 2 determines whether a turning-on operation of any one of the tone color designating switches 24 has been received. With a YES determination at step S19, the CPU 2 performs the (7) "tone color designation process" at step S20, while, with a NO determination at step S20, the CPU 2 proceeds to step S21.

Figure 7A:
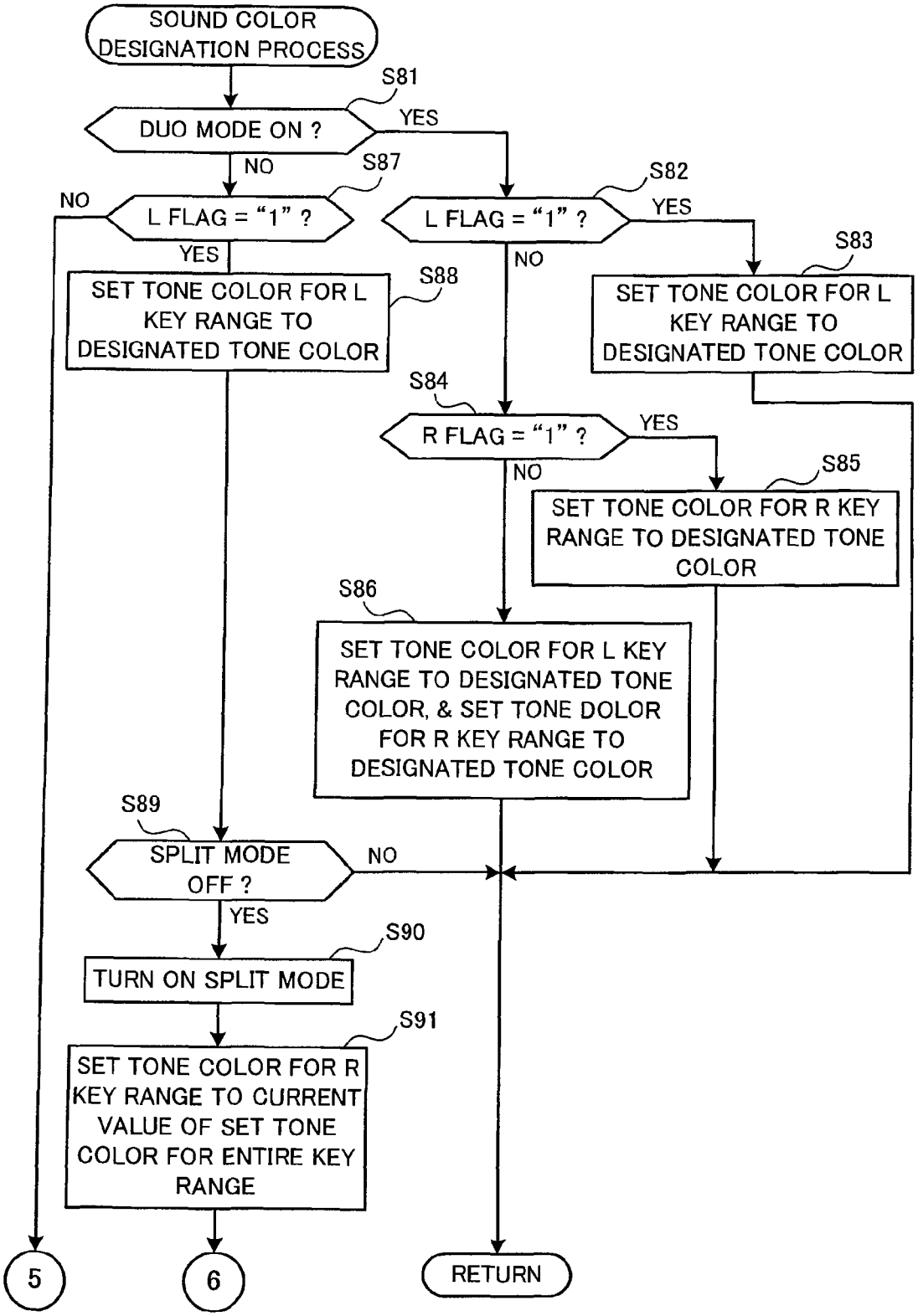
FIG. 7A is a flow chart showing an example detailed operational sequence of a tone color designation process shown in FIG. 4B.
Figure 7B:
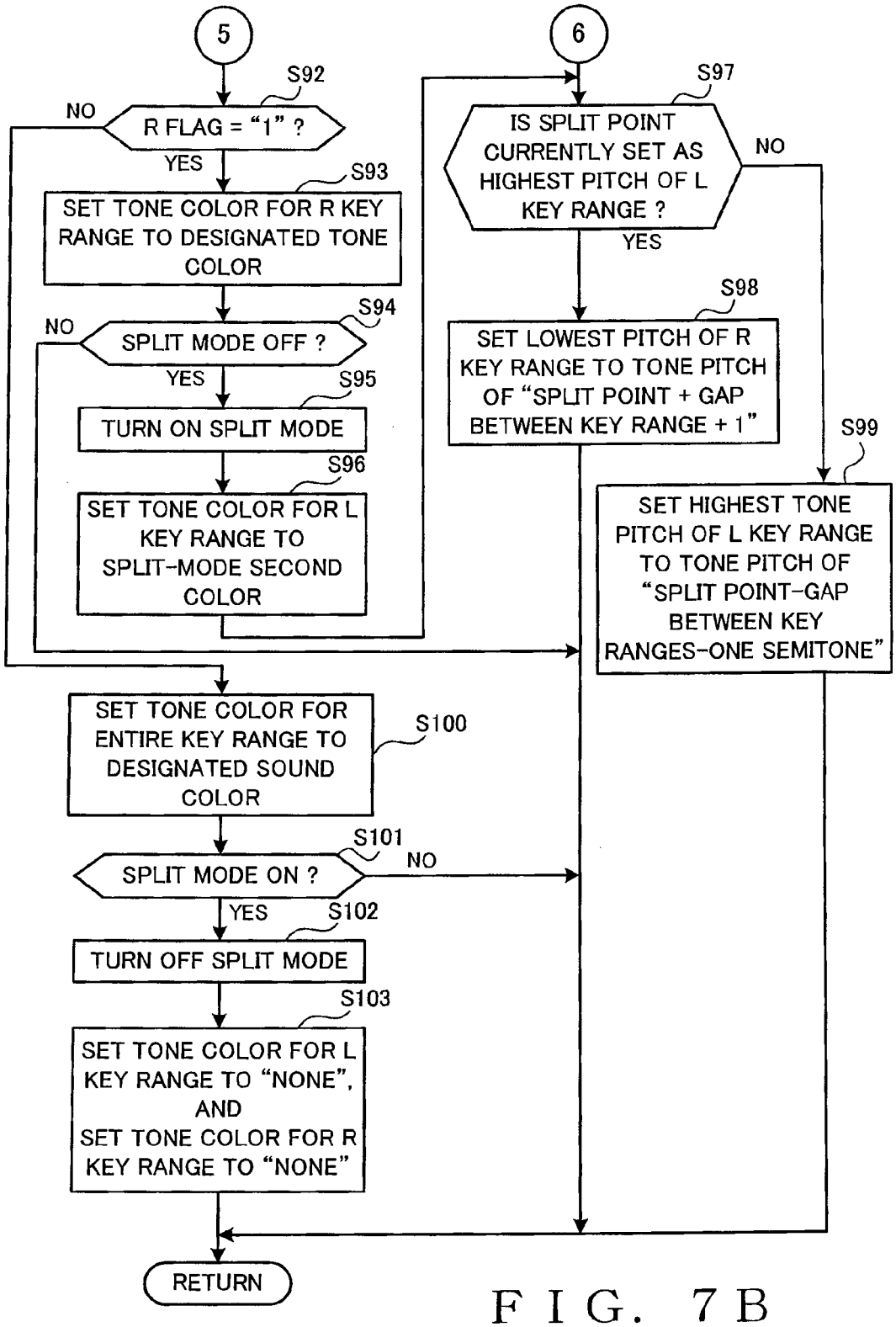
FIG. 7B is a flow chart showing the remaining part of the operational sequence of the tone color designation process of FIG. 7A.

FIGS. 7A and 7B are a flow chart showing an example detailed operational sequence of the (7) "tone color designation process". The (7) "tone color designation process" generally comprises: (7-1) "tone color designation process in the duo mode" (steps S82 to S86); and (7-2) "tone color designation process in the non-duo mode" (steps S87 to S103). The (7-2) "tone color designation process in the non-duo mode" comprises: (7-2a) "tone color designation process with the L switch 21*a* in the ON state" (steps S88 to S91, and steps S97 to S99); (7-2b) "tone color designation process with the R switch 21*b* in the ON state" (steps S93 to S99); and (7-2c) "other tone color designation process" (steps S101 to S103).

Once the (7) "tone color designation process" is started, the CPU 2 first determines, at step S81, whether the duo mode is currently selected (currently ON). If the duo mode is currently selected (currently ON) (YES determination at step S81), the CPU 2 proceeds to the (7-1) "tone color designation process" in the duo mode, but if the duo mode is not currently selected (NO determination at step S81), the CPU 2 proceeds to the (7-2) "tone color designation process in the non-duo mode".

In the (7-1) "tone color designation process in the duo mode", the CPU 2 performs any one of: (7-1a) operation for setting a designated tone color as the tone color for the L key range if the L flag="1" (step S83); (7-1b) operation for setting a designated tone color as the tone color for the R key range if the R flag="1" (step S85); and (7-1c) operation for setting a designated tone color both as the set tone color for the L key range and as the set tone color set for the R key range if the L flag="0" and the R flag="0" (step S86). After that, the CPU 2 terminates the (7) "tone color designation process".

Once the user turns on the tone color designating switch 24*d* while simultaneously turning on the L switch 21*a* in the duo-mode keyboard state shown in (g) of FIG. 3, the CPU 2 sets the designated tone color as the set tone color for the L key range at step S83, because the current operation mode is the duo mode and the L flag is currently set at "1" (L flag="1"). As a consequence, the keyboard state changes to the state shown in (h) of FIG. 3 where the tone color for the L key range is set to "tone color D". Information of the thus-set tone color for the L key range is stored into the RAM 4 as a current value of the set tone color for the L key range.

Note that the above-mentioned (7-1c) operation is performed when only the tone color designating switch 24 has been turned on in the duo mode without either one of the L and R switches 21*a* and 21*b* being turned on.

Once the (7) "tone color designation process" proceeds from step S81 to the (7-2) "tone color designation process in the non-duo mode", the CPU 2 first determines, at step S87, whether the L flag is currently in the set state (="1"). If the L flag is currently in the set state (="1") (YES determination at step S81), the CPU 2 proceeds to the (7-2a) "tone color designation process with the L switch 21*a* in the ON state".

In the (7-2a) "tone color designation process with the L switch 21*a* in the ON state", the CPU 2 sets the designated tone color as the set tone color for the L key range at step S88 as at step S83 above. Namely, information indicative of the designated tone color is stored into the RAM 4 as a current value of the set tone color for the L key range. Then, the CPU 2 determines, at step S89, whether or not the current operation mode is the split mode. If the current operation mode is the split mode (YES determination at step S89), the CPU 2 terminates the (7-2a) "tone color designation process with the L switch 21*a* in the ON state" and then terminates the (7) "tone color designation process" as well. If, on the other hand, the current operation mode is not the split mode (NO determination at step S89), the CPU 2 proceeds to step S90.

Once the user turns on the tone color designating switch 24*c* while simultaneously turning on the L switch 21*a* in the split-mode keyboard state shown in (c) of FIG. 3, the CPU 2 sets the designated tone color as the set tone color for the L key range at step S88, because the current operation mode is the split mode and the L flag is currently set at "1". As a consequence, the keyboard state changes to the state shown in (d) of FIG. 3 where the tone color for the L key range is set to "tone color C".

At step S90, the CPU 2 turns on the split mode to shift to the split mode. Namely, once an operation for designating a key range type and an operation for designating a tone color are performed in combination by the user when the current operation mode is the normal performance mode (i.e., when the duo mode and the split mode are each in the OFF state), the operation mode is automatically set to the split mode. At that time, the key-range-division-related boundary information stored in the RAM 4 is used for setting a split point. Next, the CPU 2 sets a current value of the set tone color for the entire key range as the set tone color for the R key range at step S91, and then goes to step S97 of FIG. 7B, where the CPU 2 determines, on the basis of the key-range-division-related boundary information stored in the RAM 4, whether the split point is currently set as the highest-pitch note of the L key range. If the split point is currently set as the highest-pitch note of the L key range (YES determination at step S97), the CPU 2 sets, as the lowest-pitch note of the R key range, a tone pitch of "split point+gap between the key ranges (in the instant embodiment, "0" (none))+one semitone" at step S98, then terminates the (7-2a) "tone color designation process with the L switch 21*a* in the ON state" and then terminates the (7) "tone color designation process" as well. If the split point is not currently set as the highest-pitch note of the L key range (NO determination at step S97), the CPU 2 sets, as the highest-pitch note of the L key range, a tone pitch of "split point−gap between the key ranges (in the instant embodiment, "0" (none))−one semitone" at step S99, then terminates the (7-2a) "tone color designation process with the L switch 21*a* in the ON state" and then terminates the (7) "tone color designation process" as well.

If, on the other hand, the L flag is currently "0" (NO determination at step S87), the CPU 2 determines, at step S92 of FIG. 7B, whether the R flag is currently in the set state (R flag="1"). If the R flag is currently in the set state (="1") (YES determination at step S92), the CPU 2 proceeds to the (7-2b) "tone color designation process with the R switch 21*b* in the ON state".

In the (7-2b) "tone color designation process with the R switch 21*b* in the ON state", the CPU 2 first sets the designated tone color as the set tone color for the R key range at step S93. Namely, information indicative of the designated tone color is stored into the RAM 4 as a current value of the set tone color for the R key range. Then, the CPU 2 determines, at step S94, whether or not the current operation mode is the split mode. If the current operation mode is the split mode (YES determination at step S94), the CPU 2 terminates the (7-2b) "tone color designation process with the R switch 21*b* in the ON state" and then terminates the (7) "tone color designation process" as well. If the current operation mode is not the split mode (NO determination at step S94), the CPU 2 proceeds to step S95.

At step S95, the CPU 2 turns on the split mode to shift to the split mode. Because such step S95 is performed when the R key range has been designated, the boundary information of the highest-pitch note of the R key range stored in the RAM 4 is used for setting a split point. After that, the CPU 2 sets a split-mode second tone color as the set tone color for the L key range at step S96 and then moves to step S97. Details of steps S97 and other steps following step S97 have already been described above and thus will not be described here to avoid unnecessary duplication.

As apparent from the foregoing, the arrangements for implementing the operations of steps S88, S93, etc. via the CPU 2 correspond to a tone color setting section that, once any one tone color is designated by the tone color designation section (24*a*, 24*b*, . . . ) in association with designation of a key range by the key range designation section (21*a*, 21*b*), sets the designated tone color as a tone color to be used in the designated key range.

Further, the arrangements for implementing the operations of steps S87 to S90, S92 to S95, etc. via the CPU 2 correspond to a division setting section that, once any one tone color is designated by the tone color designation section (24*a*, 24*b*, . . . ) in association with designation of a key range by the key range designation section (21*a*, 21*b*) when the keyboard is not set in the divided usage state where the keyboard is usable divided in a plurality of key ranges, divides the keyboard into a plurality of key ranges on the basis of the boundary information stored in the storage section (4).

Further, the arrangements for implementing the operations of steps S87 to S90, S92 to S95, etc. via the CPU 2 correspond to a division and tone color setting section that, once any one tone color is designated by the tone color designation section in association with designation of a key range by the key range designation section when the keyboard is not set in the divided usage state where the keyboard is usable divided in a plurality of key ranges, (1) divides the keyboard into a plurality of key ranges on the basis of the boundary information stored in the storage section and sets the keyboard in the divided usage state (steps S87 to S90, and S92 to S95) and (2) sets the designated tone color as a tone color to be used in the designated key range (S88 and S93).

Further, once the user turns on the tone color designation switch 24*e* while simultaneously turning on the R switch 21*b* after cancelling the duo mode by turning on the duo mode switch 22 in the duo-mode keyboard state shown in (h) of FIG. 3, the CPU 2 sets the designated tone color as the tone color for the R key range at step S93, because the current operation mode is the normal performance mode, not the duo mode and the R flag is currently set at "1". Because the split mode is currently OFF, the CPU 2 sets the split mode in the ON state at step S95 and then sets the split-mode second tone color, i.e. "tone color G", as the set tone color for the L key range at step S96. Further, because the split point (highest-pitch note of the L key range), i.e. "E3", set when the operation mode shifted to the duo mode is not cleared even if the duo mode is cancelled, namely, because the "E3" split point has been backed up, the CPU 2 determines L and R key ranges on the basis of the split point. More specifically, the CPU 2 sets the split point as the highest-pitch note of the L key range and sets, as the lowest-pitch note of the R key range, a tone pitch one semitone higher than the split point (because no gap is provided between the L and R key ranges in the instant embodiment), at step S98. As a consequence, the keyboard state changes to the state shown in (i) of FIG. 3 where the L and R key ranges are set to a range from "A-1" to "E3" and a range from "F3" to "C7", respectively, and the L and R key ranges are set at "tone color G" and "tone color E", respectively.

If, on the other hand, the R flag="0" as determined at step S92 (NO determination at step S92), the CPU 2 proceeds to the (7-2c) "other tone color designation process".

In the (7-2c) "other tone color designation process", the CPU 2 first sets the designated tone color as the set tone color for the entire key range at step S100. Then, the CPU 2 determines, at step S101, whether or not the current operation mode is the split mode. If the current operation mode is the split mode (YES determination at step S101), the CPU 2 proceeds to step S102, while, if the current operation mode is not the split mode (NO determination at step S101), the CPU 2 terminates the (7-2c) "other tone color designation process" and then terminates the (7) "tone color designation process" as well.

At step S101, the CPU 2 turns off the split mode to cancel the split mode. Then, the CPU 2 sets "none" as both of the set tone colors for the L and R key ranges at step S103, then terminates the (7-2c) "other tone color designation process" and then terminates the (7) "tone color designation process" as well.

Referring back to FIG. 4B, the CPU 2 determines, at step S21, whether or not any other user's instructing operation has been received. If any other user's instructing operation has been received (YES determination at step S21), the CPU 2 performs the (8) "other processing" at step S22, while, if no other user's instructing operation has been received (NO determination at step S21), the CPU 2 reverts step S2 of FIG. 4A.

In the (8) "other processing", the CPU 2 performs various other processes, such as a process for setting a master volume corresponding to a user's operation of the volume slider 23, a process corresponding to a user's operation of a pedal provided in the input operation section 1 and a process responsive, for example, to a reproduction start/stop instruction given for a selected music piece after the operation mode shifts to the music piece reproduction mode.

At step S2, the CPU 2 determines whether or not an end operation has been received. With a YES determination at step S2, the CPU 2 performs the (9) "end process" at step S23, while, with a NO determination at step S2, the CPU 2 performs the (2) "L and R flag control process".

In the (9) "end process", if there is any tone being currently generated, the CPU 2 deadens the tone at step S23 and then stores the current value of the split point into a predetermined area of the RAM 4 at step S24. In a case where the RAM 4 is of an ordinary volatile type, and when the (9) "end process" is performed in response to turning-off of the power supply, the stored content of the RAM 4 would be undesirably deleted in response to the turning-off of the power supply. To avoid such undesired deletion, the RAM 4 need to be of a non-volatile type, such an NV (Non-Volatile) RAM, a power-backed-up RAM, a flash memory or the like.

Whereas the preferred embodiment of the electronic musical instrument of the present invention has been described above in relation to the case where any one of a plurality of types of key ranges (L and R key ranges) is designated and where items to be set for the designated type of key range are "split point" and "tone color", the present invention is not so limited, and any other items, such as "tone volume balance", "octave" and "effecter", may be set for the designated type of key range.

Further, the preferred embodiment of the electronic musical instrument of the present invention may have any other functions than the function for generating a performance tone in response to the user depressing a key of the keyboard, such as a function for generating a tone by reproducing internally-stored music piece data or externally-input music piece data, and a function for inputting performance data from another electronic musical instrument and generating a tone by reproducing the thus-input performance data.

Furthermore, whereas the preferred embodiment of the electronic musical instrument has been described above in relation to the case where the key range of the keyboard is divided into two types of key ranges, i.e. L and R key ranges, this is solely for simplicity of description. Namely, the present invention is not limited to just two types of key ranges, and the key range of the keyboard may be divided into three or more types of key ranges. For example, another key range (intermediate or middle key range) may be provided between the L and R key ranges. In the case where three or more types of key ranges are provided like this, it is necessary to provide a key range type designation section for designating any desired one of the types of key ranges; such a key range type designation section may comprise a predetermined number of switches corresponding to the designatable types of key ranges.

Furthermore, whereas the preferred embodiment of the electronic musical instrument of the present invention has been described above in relation to the case where no gap is provided between the adjoining key ranges, this is also solely for simplicity of description. Namely, a gap (i.e., unused key range) may be provided between the adjoining key ranges. Note, however, that the operational sequences depicted in the flow charts of the control processing are arranged to be capable of dealing with the case where such a gap (unused key range) is provided between the adjoining key ranges (see steps S39, S62, S67, S98 and S99 described above). In the case where a gap (unused key range) is provided between the adjoining divided key ranges, the gap may be determined in advance by default, for example, as a gap of a certain number of semitones, or may be set as desired by the user. Further, in the case where the number of the divided key ranges is three or more, gaps between the divided key ranges, i.e. distances, each indicated for example by the number of semitones, degrees or musical intervals, between the divided key ranges may be identical to one another or may be set individually.

Furthermore, the preferred embodiment of the electronic musical instrument of the present invention has been described above in relation to the case where dedicated operators are provided for designation of any desired one of the key range types and turning on/off (designation of the ON or OFF state) of the duo mode. Alternatively, such designation of any desired one of the key range types and designation of the ON or OFF state of the duo mode may be effected through user's operations of combinations of predetermined ones of other operators assigned to other functions of the above-described embodiment, without the dedicated operators being provided for the designation of any desired one of the key range types and designation of the ON or OFF state of the duo mode. As another alternative, the designation of any desired one of the key range types and designation of the ON or OFF state of the duo mode may be effected by the user operating one predetermined operator in accordance with any of a plurality of different operation styles. Furthermore, the electronic musical instrument of the present invention may be constructed to provide an alternative form of operations where operators displayed, for example, on a touch panel, rather than the hardware operators provided on the operation panel, are selectively operable for the aforementioned functions.

Furthermore, the default settings of the split point, tone color, etc. may be made changeable.

Furthermore, whereas the preferred embodiment of the electronic musical instrument has been described above in relation to the case where dual tone colors cannot be designated while the split mode is selected as the operation mode, it may be constructed in such a manner that a second tone color can be set for the right key range. In such a case, a first (i.e., main) tone color is given priority over the second tone color, for example, when the operation mode has shifted to the duo mode or when the split mode has been canceled.

In a case where the electronic musical instrument of the present invention is equipped with an accompaniment style, the L key range in the split mode is used also as a chord-designating key range. In such a case, a tone of a depressed key in the L range (chord input) is not audibly generated. Further, an accompaniment when an accompaniment style is used is sounded with tone colors set in accompaniment style data.

Furthermore, whereas the preferred embodiment of the electronic musical instrument has been described above in relation to the case where, while any one of the key-range-type designating operators, i.e. L and R switches 21*a* and 21*b*, is in the ON state, the key range designated by the key-range-type designating operator is selected as a target or object of setting. However, the present invention is not so limited, the key range designated by the key-range-type designating operator may be switched between the state of being an object of setting and the state of being a non-object of setting each time the key-range-type designating operator is turned on. Further, the operators may be of any other type than the switch type, such as a lever or slider type.

In the case where the number of types of key ranges is three or more and where an intermediate or middle key range is to be set, a split point may be set by designating the lowest-pitch note and highest-pitch note of the middle key range.

Normally, setting of a split point is performed via the keyboard (performance operator unit). Alternatively, key range division and tone color control may be performed by a program of a PC (Personal Computer), and a performance may be executed via a master keyboard connected to the PC.

Furthermore, whereas the preferred embodiment has been described above in relation to the case where a tone color set for the R key range is given priority at the time of cancellation of the split mode, such as at the time of shift to the duo mode, a tone color set for the L key range may be given priority at the time of cancellation of the split mode.

Needless to say, the objects of the present invention can be accomplished by supplying a system or apparatus with a storage medium having stored therein program codes of software implementing the functions of the above-described embodiment so that a computer (CPU or MPU) of the system or apparatus reads out and executes the program codes stored in the storage medium. In such a case, the program codes read out from the storage medium themselves implement the novel functions of the present invention, and these program codes and the storage medium having stored therein the program codes together implement the present invention. Furthermore, the storage medium for providing the program codes may be, for example, a flexible disk, hard disk, magneto-optical disk, CD-ROM, CD-R, CD-RW, DVD-ROM, DVD-RAM, DVD-RW, DVD+RW, magnetic tape, non-volatile memory card, ROM or the like. As another alternative, the program codes may be supplied from a server computer via a communication network.

Moreover, whereas the functions of the above-described embodiment of the invention have been described above as implemented by the computer reading out and executing the program codes, they may of course be implemented by an OS and the like, running on the computer, performing a part or whole of the actual processing on the basis of the instructions of the program codes. As still another alternative of the present invention, the program codes, read out from the storage medium may be written into a function extension board inserted in the computer or a memory provided in a function extension unit connected to the computer so that the functions of the above-described embodiment can be implemented by a CPU and the like, provided in the function extension board or the function extension unit, performing a part or whole of the actual processing on the basis of the instructions of the program codes.

This application is based on, and claims priority to, JP PA 2012-039830 filed on 27 Feb. 2012. The disclosure of the priority application, in its entirety, including the drawings, claims, and the specification thereof, are incorporated herein by reference.

What is claimed is:

1. An electronic musical instrument comprising:

a key range designation section adapted to selectively designate any one of a plurality of types of key ranges of a keyboard;

a key range determination section adapted to receive information designating a boundary key position in association with designation of the designated type of key range by said key range designation section and determine an actual key range of the designated type of key range in accordance with the boundary key position designated by the received information in such a manner that the designated boundary key position belongs to the actual key range of the designated type of key range;

a key-range-division setting section adapted to, on the basis of the actual key range determined by said key range determination section, set the keyboard in a divided usage state where the keyboard is usable divided in a plurality of key ranges;

a selector for selecting a duo mode; and a duo-mode key-range setting section adapted to, in response to selection via said selector of the duo mode, cancel the divided usage state set by said key-range-division setting section and set the keyboard into a state where the keyboard is usable divided in predetermined two key ranges.

2. The electronic musical instrument as claimed in claim 1, wherein said key range determination section is adapted to receive, as the information designating a boundary key position, information designating a key position of at least one of an upper limit and a lower limit of the designated type of key range.

3. The electronic musical instrument as claimed in claim 1, wherein said key range determination section is adapted to automatically determine, in accordance with a first actual key range determined in association with the designated type of key range, a second actual key range corresponding to at least one other key range having not been designated by said key range designation section.

4. The electronic musical instrument as claimed in claim 3, wherein said key range determination section automatically determines the second actual key range, corresponding to the at least one other key range, that adjoins the first actual key range determined in association with the designated type of key range.

5. The electronic musical instrument as claimed in claim 3, wherein said key range determination section automatically determines the second actual key range, corresponding to the at least one other key range, such that the second actual key range is spaced from the first actual key range determined in association with the designated type of key range.

6. The electronic musical instrument as claimed in claim 5, wherein, once information designating an upper-limit key position of the designated type of key range is received as said information designating a boundary key position, said key range determination section automatically determines the second actual key range such that a lower-limit key of the second actual key range is located at a position spaced in a higher pitch direction, by a predetermined number of keys, from the first actual key range determined in association with the designated type of key range, and wherein, once information designating a lower-limit key position of the designated type of key range is received as said information designating a boundary key position, said key range determination section automatically determines the second actual key range such that an upper-limit key of the second actual key range is located at a position spaced in a lower pitch direction, by the predetermined number of keys, from the first actual key range determined in association with the designated type of key range.

7. The electronic musical instrument as claimed in claim 1, which further comprises:

a tone color designation section adapted to designate any one of a plurality of tone colors; and a tone color setting section adapted to, once any one of the tone colors is designated by said tone color designation section in association with designation of the designated type of key range by said key range designation section, set the designated tone color as a tone color to be used in the designated type of key range.

8. The electronic musical instrument as claimed in claim 7, which further comprises:

a storage section storing boundary information for allowing the keyboard to be used divided in a plurality of key ranges; and a division setting section adapted to, once any one tone color is designated by said tone color designation section in association with designation of the designated type of key range by said key range designation section when the keyboard is not set in a divided usage state where the keyboard is usable divided in a plurality of key ranges, divide the keyboard into a plurality of key ranges on the basis of the boundary information stored in said storage section and thereby sets the keyboard into the divided usage state.

9. The electronic musical instrument as claimed in claim 1, which further comprises a tone pitch adjustment section adapted to, when the keyboard is in said state where the keyboard is usable divided in predetermined two key ranges, make adjustment such that at least a portion of a pitch range of tones generatable in association with individual ones of the predetermined two key ranges is sharable between the predetermined two key ranges.

10. The electronic musical instrument as claimed in claim 1, which further comprises a duo-mode tone color setting section adapted to, in response to selection via said selector of the duo mode, set, as a tone color sharable between the predetermined two key ranges, a tone color currently set for a predetermined key range having previously been set in the canceled divided usage state.

11. The electronic musical instrument as claimed in claim 1, wherein said key range designation section is configured in such a manner that any one of the plurality of types of key ranges is designated in response to a user's operation, and said key range determination section is configured to receive information designating the boundary key position in response to a user's operation.

12. An electronic musical instrument comprising:

a key range designation section adapted to individually designate any one of a plurality of key ranges;

a tone color designation section adapted to designate any one of a plurality of tone colors;

a storage section storing boundary information for allowing a keyboard to be used divided in a plurality of key ranges;

a division and tone color setting section adapted to, once any one tone color is designated by said tone color designation section in association with designation of a key range by said key range designation section when the keyboard is not set in a divided usage state where the keyboard is usable divided in a plurality of key ranges, (1) divide the keyboard into a plurality of key ranges on the basis of the boundary information stored in said storage section and (2) set the designated tone color as a tone color to be used in the designated key range;

an update section adapted to, once information designating a boundary key position in association with designation of a key range by said key range designation section is received when the keyboard is set in the divided usage state, update the boundary information stored in said storage section on the basis of the designated key range and the boundary key position indicated by the received information, wherein, once the boundary information is updated by said update section, said division and tone color setting section re-sets a key-range-divided state of the keyboard on the basis of the updated boundary information;

a selector for selecting a duo mode; and a duo-mode key-range setting section adapted to, in response to selection via said selector of the duo mode, cancel the divided usage state and set the keyboard into a state where the keyboard is usable divided in predetermined two key ranges.

13. The electronic musical instrument as claimed in claim 12, wherein, once information designating an upper-limit key position of the designated key range is received as said information designating a boundary key position, said key range determination section automatically determines a second key range such that a lower-limit key of the second key range is located at a position spaced in a higher pitch direction, by a predetermined number of keys, from a first key range determined in association with the designated key range, and wherein, once information designating a lower-limit key position of the designated key range is received as said information designating a boundary key position, said update section automatically determines a second actual key range such that an upper-limit key of the second key range is located at a position spaced in a lower pitch direction, by a predetermined number of keys, from a first key range determined in association with the designated key range.

14. A processor-implemented method for using a keyboard on an electronic musical instrument in a key-range-divided fashion, said method comprising:

receiving, by a processor, a user's input operation for selectively designating any one of a plurality of types of key ranges of the keyboard, the user's input operation performed on one or more user-operable input operators;

receiving, by the processor, information designating a boundary key position on the keyboard in association with designation of the designated type of key range based on the user's input operation, the received information indicating a user's operation on the keyboard;

determining, by the processor, an actual key range of the designated type of key range in accordance with the boundary key position designated by the received information in such a manner that the designated boundary key position on the keyboard belongs to the actual key range of the designated type of key range of the keyboard;

on the basis of the determined actual key range, setting, by the processor, the keyboard in a divided usage state where the keyboard is usable divided in a plurality of key ranges;

receiving, by the processor, a user's input operation for selecting a duo mode; and in response to the user's input operation for selecting the duo mode, canceling, by the processor, the divided usage state and setting, by the processor, the keyboard into a state where the keyboard is usable divided in predetermined two key ranges.

15. A processor-implemented method for using a keyboard on an electronic musical instrument in a key-range divided fashion, the electronic musical instrument including a storage memory storing boundary information for allowing the keyboard to be used divided in a plurality of key ranges, said method comprising:

receiving, by a processor, a user's input operation for individually designating any one of a plurality of key ranges of the keyboard, the user's input operation performed on one or more user-operable input operators;

once information designating any tone color in association with designation of the key range based on the user's input operation is received when the keyboard is not set in a divided usage state where the keyboard is usable divided in a plurality of key ranges, (1) dividing, by the processor, the keyboard into a plurality of key ranges on the basis of the boundary information stored in the storage memory and (2) setting, by the processor, the designated tone color as a tone color to be used in the designated key range of the keyboard;

once information designating a boundary key position on the keyboard in association with the designation of the key range based on the user's input operation is received when the keyboard is set in the divided usage state, updating, by the processor, the boundary information stored in the storage memory on the basis of the designated key range and the boundary key position indicated by the received information, the received information indicating a user's operation on the keyboard;

once the boundary information is updated, re-setting a key-range-divided state of the keyboard on the basis of the updated boundary information;

receiving, by the processor, a user's input operation for selecting a duo mode; and in response to the user's input operation for selecting the duo mode, canceling, by the processor, the divided usage state and setting, by the processor, the keyboard into a state where the keyboard is usable divided in predetermined two key ranges.

16. A non-transitory computer-readable storage medium containing a program for causing a computer to perform a method for using a keyboard on an electronic musical instrument in a key-range-divided fashion, said method comprising:

receiving a user's input operation for selectively designating any one of a plurality of types of key ranges of the keyboard, the user's input operation performed on one or more user-operable input operators;

receiving information designating a boundary key position on the keyboard in association with designation of the designated type of key range based on the user's input operation, the received information indicating a user's operation on the keyboard;

determining an actual key range of the designated type of key range in accordance with the boundary key position designated by the received information in such a manner that the designated boundary key position on the keyboard belongs to the actual key range of the designated type of key range of the keyboard;

on the basis of the determined actual key range, setting the keyboard in a divided usage state where the keyboard is usable divided in a plurality of key ranges;

receiving a user's input operation for selecting a duo mode; and in response to the user's input operation for selecting the duo mode, canceling the divided usage state and setting the keyboard into a state where the keyboard is usable divided in predetermined two key ranges.

17. A non-transitory computer-readable storage medium containing a program for causing a computer to perform a method for using a keyboard on an electronic musical instrument in a key-range-divided fashion, the electronic musical instrument including a storage memory storing boundary information for allowing the keyboard to be used divided in a plurality of key ranges, said method comprising:

receiving a user's input operation for individually designating any one of a plurality of types of key ranges of the keyboard, the user's input operation performed on one or more user-operable input operators;

once information designating any tone color in association with designation of the key range based on the user's input operation is received when the keyboard is not set in a divided usage state where the keyboard is usable divided in a plurality of key ranges, (1) dividing the keyboard into a plurality of key ranges on the basis of the boundary information stored in the storage memory and (2) setting the designated tone color as a tone color to be used in the designated key range of the keyboard;

once information designating a boundary key position on the keyboard in association with the designation of the key range based on the user's input operation is received when the keyboard is set in the divided usage state, updating the boundary information stored in the storage memory on the basis of the designated key range and the boundary key position indicated by the received information, the received information indicating a user's operation on the keyboard;

once the boundary information is updated, re-setting a key-range-divided state of the keyboard on the basis of the updated boundary information;

receiving a user's input operation for selecting a duo mode; and in response to the user's input operation for selecting the duo mode, canceling the divided usage state and setting the keyboard into a state where the keyboard is usable divided in predetermined two key ranges.

18. An electronic musical instrument comprising:

one or more first user-operable input operators adapted to selectively designate any one of a plurality of types of key ranges of a keyboard;

one or more second user-operable input operators adapted to select a duo mode; and a processor adapted to;

receive information designating a boundary key position in association with designation of the designated type of key range by said one or more first user-operable input operators;

determine an actual key range of the designated type of key range in accordance with the boundary key position designated by the received information in such a manner that the designated boundary key position belongs to the actual key range of the designated type of key range;

on the basis of the determined actual key range, set the keyboard in a divided usage state where the keyboard is usable divided in a plurality of key ranges; and in response to selection of the duo mode via said one or more second user-operable input operators, cancel the divided usage state set and set the keyboard into a state where the keyboard is usable divided in predetermined two key ranges.

19. An electronic musical instrument comprising:

one or more user-operable first input operators adapted to individually designate any one of a plurality of types of key ranges;

one or more user-operable second input operators adapted to designate any one of a plurality of tone colors;

a storage memory storing boundary information for allowing a keyboard to be used divided in a plurality of key ranges;

one or more third user-operable input operators adapted to select a duo mode; and a processor adapted to:

once any one tone color is designated by said one or more user-operable second input operators in association with designation of a key range by said one or more user-operable first input operators when the keyboard is not set in a divided usage state where the keyboard is usable divided in a plurality of key ranges, (1) divide the keyboard into a plurality of key ranges on the basis of the boundary information stored in said storage memory and (2) set the designated tone color as a tone color to be used in the designated key range;

once information designating a boundary key position in association with designation of a key range by said one or more user-operable first input operators is received when the keyboard is set in the divided usage state, update the boundary information stored in said storage memory on the basis of the designated key range and the boundary key position indicated by the received information;

once the boundary information is updated, re-set a key-range-divided state of the keyboard on the basis of the updated boundary information;

in response to selection of the duo mode via said one or more third user-operable input operators, cancel the divided usage state set and set the keyboard into a state where the keyboard is usable divided in predetermined two key ranges.

* * * * *